US007258084B2

(12) United States Patent
Maling

(10) Patent No.: US 7,258,084 B2
(45) Date of Patent: Aug. 21, 2007

(54) EXPLICIT SEALS FOR MOVING CYLINDER ASSEMBLY

(76) Inventor: Charles Maling, 496 Harmony La., Boone, NC (US) 28657

( * ) Notice: Subject to any disclaimer, the term of this patent is extended or adjusted under 35 U.S.C. 154(b) by 0 days.

(21) Appl. No.: 11/229,462

(22) Filed: Sep. 16, 2005

(65) Prior Publication Data

US 2006/0054114 A1 Mar. 16, 2006

Related U.S. Application Data

(60) Provisional application No. 60/610,362, filed on Sep. 16, 2004.

(51) Int. Cl.
*F02B 59/00* (2006.01)

(52) U.S. Cl. ..... 123/42

(58) Field of Classification Search ..... 123/42, 123/18 R, 45 R; 277/591
See application file for complete search history.

(56) References Cited

U.S. PATENT DOCUMENTS

| | | | | |
|---|---|---|---|---|
| 1,128,757 | A | | 2/1915 | Chandler |
| 1,181,974 | A | | 5/1916 | Blye |
| 1,363,894 | A | | 12/1920 | Molstad |
| 1,671,254 | A | | 5/1928 | Porter |
| 1,672,564 | A | | 6/1928 | Frazier |
| 1,774,713 | A | | 9/1930 | Jahn et al. |
| 1,977,025 | A | | 10/1934 | Elst et al. |
| 2,017,196 | A | | 10/1935 | Anglada et al. |
| 2,048,134 | A | | 7/1936 | Montalto |
| 2,330,583 | A | | 9/1943 | Heylandt et al. |
| 2,725,043 | A | | 9/1955 | Bacot |
| 3,896,781 | A | | 7/1975 | Smith |
| 4,010,719 | A | * | 3/1977 | Lappa ..... 123/44 C |
| 4,467,751 | A | | 8/1984 | Asaka et al. |
| 4,976,232 | A | | 12/1990 | Coates |
| 6,289,872 | B1 | | 9/2001 | Dardalis |
| 6,666,458 | B2 | | 12/2003 | Coates |
| 6,718,933 | B1 | | 4/2004 | Coates |
| 6,880,511 | B1 | | 4/2005 | Coates |

* cited by examiner

*Primary Examiner*—Noah P. Kamen
*Assistant Examiner*—Jason Benton
(74) *Attorney, Agent, or Firm*—Adams Evans P.A.

(57) ABSTRACT

A moving cylinder assembly includes an end ported moveable cylinder having a chamber for receiving and engaging a piston connected to at least one crank. A stationary housing embraces the cylinder and has at least one port for intermittent communication with the cylinder chamber. One or more ported seals are positioned within the housing and adjacent the cylinder to minimize leakage.

28 Claims, 26 Drawing Sheets

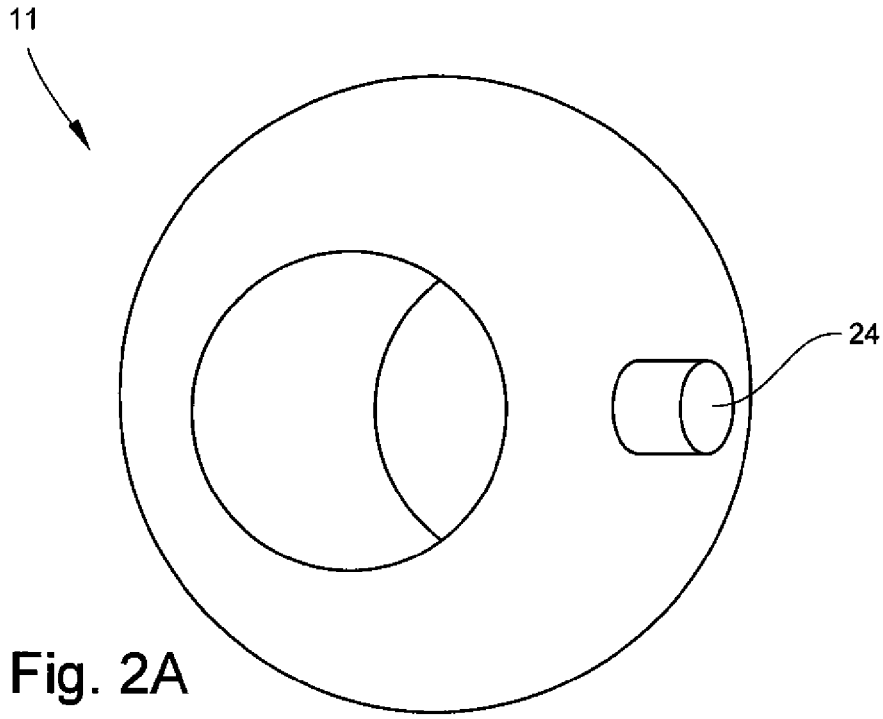
Fig. 2A
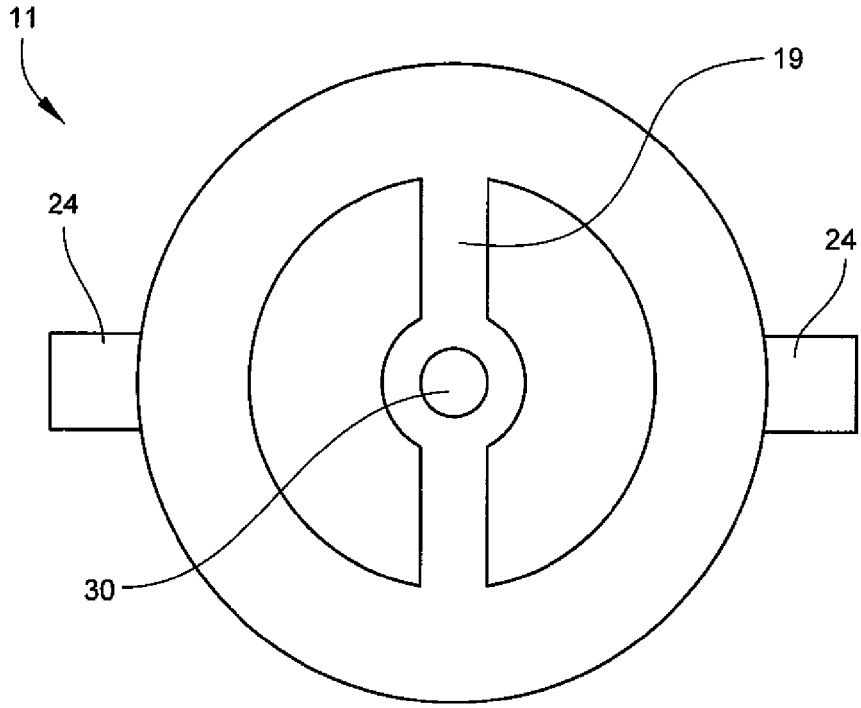
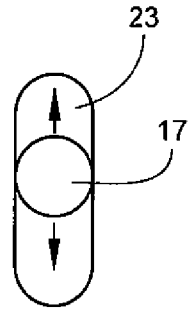
Fig. 2C
Fig. 2B

EXPLICIT SEALS FOR MOVING CYLINDER ASSEMBLY

This application claims priority to U.S. Provisional Application No. 60/610,362, filed Sep. 16, 2004, which is incorporated herein by reference.

This invention relates to an adaptation of the invention described in International Application No. PCT/US2004/008434 titled "Embraced Moving Cylinder and Methods of Using Same." The adaptation involves introducing a deliberate non-sealing gap between the moving cylinder and its embracing housing and by inclusion of explicit seals in that gap. Use of explicit seals allows the clearances between the moving cylinders and the embracing housings of that application to be less tight without introducing leakage. Larger clearances are less demanding of precision in manufacture and can more easily accommodate temperature changes within the assembly, without risking seizure of the moving parts. Explicit seals will also enable the attainment of higher pressure differentials. The latter is likely to be especially important to the functioning of internal combustion engines using the assemblies of the invention. Additionally, the explicit seals of this invention would enable further means to cool the cylinder.

Two basic types of seals are disclosed: resilient linings, jackets or coatings bridging a gap between cylinder and housing, and mechanical seals engaging with springs, pressure, and centrifugal force.

Seals using resilient materials are very commonplace. Most often they are in the form of 'O' rings or washer shaped rings held between the parts where sealing is required. Sometimes the resilient seal material is bonded to one of the parts, such as is usually done to the metal lids of glass jars.

The mechanical seals disclosed herein for end-ported oscillating cylinders are similar to some of the seals in the patent record for rotary valves. Although the engine mechanics are very different, the sealing requirements are very similar to that of rotary valve engines. Rotary valve engines generally use either cylindrical or spherical valves. The most basic cylinder shapes of the prior International Application No. PCT/US2004/008434 are likewise cylindrical and spherical. Means similar to the likely most likely successful mechanical seals of rotary valves can be used to seal the cylinders of the prior application.

Seals mechanically engaging against rotary valves can generally be sorted into three types. Simplest are seals which are engaged by the action of a spring. U.S. Pat. No. 1,128,757 to M. G. Chandler, and U.S. Pat. No. 1,363,894 to A. Molstad, offer seals that fall into this category. More sophisticated are seals which engage lightly with springs but engage with additional force when pressures are high. U.S. Pat. No. 1,671,254 to F. R. Porter, U.S. Pat. No. 2,017,196 to J. A. Anglada et al., U.S. Pat. No. 2,330,583 to C. W. P. Heylandt et al., U.S. Pat. No. 3,896,781 to George O. Smith, use seals of this type. Finally, and most likely to be successful, are seals which engage lightly with springs, more heavily with pressure, and with piston-type rings around the seals providing an additional restraint on blow-by. Seals of this type are offered in U.S. Pat. No. 1,181,974 to H. C Blye, U.S. Pat. No. 1,672,564 to F. G. Frazier, U.S. Pat. No. 1,774,713 to J. R. Jahn et al., U.S. Pat. No. 1,977,025 to J. Vander Elst et al., U.S. Pat. No. 2,048,134 to L. Montalto, U.S. Pat. No. 2,725,043 to J. L Bacot, U.S. Pat. No. 4,467,751 to Asaka et al., U.S. Pat. Nos. 4,976,232, 6,666,458, 6,718,933, and 6,880,511 to George J. Coates. The mechanical seals disclosed in this application are of this latter type. Also disclosed in this application is an alternative means to provide pressure to the back side of the rings used so as to increase the sealing force of those rings. Other means are offered in the Asaka '751 and the Coates '933 patents.

A unique feature of the present invention is the application of resilient and mechanical seals to end ported moving cylinders embraced by fixed housings. Also unique are the original means offered to address the specific sealing requirements of such assemblies.

One objective of the present invention is to provide a means to prevent the loss of hydrodynamic lubrication for a piston when it momentarily stops at the ends of its throws. For the case of a linearly sliding cylinder, a means to do that is offered, which makes use of that linear movement itself to spin the cylinder barrel. That spinning cylinder barrels could lead to less wear was noticed in the sleeve valve engines of the 1920's through 1940's. U.S. Pat. No. 6,289,872 to Dardalis discloses a different means to rotate cylinder sleeves in conventional engines with the goal of durability.

SUMMARY OF THE INVENTION

Therefore, It is an object of the present invention to provide methods of sealing assemblies with end ported moving cylinders embraced by generally fixed housings or frames.

Another object of the present invention is to provide a method to cool a moving cylinder assembly which has seals according to the invention. Another object of the present invention is to provide a method to spin the cylinder of one of the cylinder/seal assemblies of this invention so as to reduce wear. Another object of the present invention is to provide cylinder/seal assemblies for use in an internal combustion engine.

Another object of the present invention is to provide cylinder/seal assemblies for use in an internal combustion engine, which achieve a more efficient passing of flows between the assemblies.

These and other objects of the present invention are achieved in the preferred embodiments disclosed below providing a cylinder defining a chamber for receiving and engaging a piston connected directly to one or more crankshafts. The cylinder is adapted for reciprocal oscillating or sliding movement with the piston and has at least one opening. A housing embraces the cylinder and has at least one port for intermittent communication with the cylinder opening, and a seal is positioned within the housing and adjacent to the cylinder to minimize leakage.

According to one preferred embodiment of the invention, the sealing interface between the moving cylinder and the fixed housing is cylindrical.

According to another preferred embodiment of the invention, the sealing interface between moving cylinder and fixed housing is planar.

According to yet another preferred embodiment of the invention, the sealing interface is spherical.

According to yet another preferred embodiment of the invention, the sealing interface is achieved with a resilient jacket or coating to a moving cylinder embraced by a generally fixed housing.

According to yet another preferred embodiment of the invention, sealing is achieved with a resilient lining or coating to the housing or frame embracing the moving cylinder.

According to yet another preferred embodiment of the invention, the sealing interface is achieved by a mechanical seal on the end of a moving cylinder pressing against the housing or frame.

According to yet another preferred embodiment of the invention, the sealing is achieved by a mechanical seal within a housing or frame pressing against the cylinder it embraces.

According to yet another preferred embodiment of the invention, the sealing is achieved by a mechanical seal within a housing or frame pressing against another mechanical seal on the end of the moving cylinder it embraces.

BRIEF DESCRIPTION OF THE DRAWINGS

FIG. 2A is a perspective view of a cylinder used in conjunction with a resilient lining or jacket according to the invention;

FIG. 2B is an elevation of the cylinder of FIG. 2A as viewed from the crankpin;

FIG. 2C is a view of a piston rod positioned within a slot in a housing according to the invention;

DETAILED DESCRIPTION OF THE PREFERRED EMBODIMENTS AND BEST MODE

Figure 1:
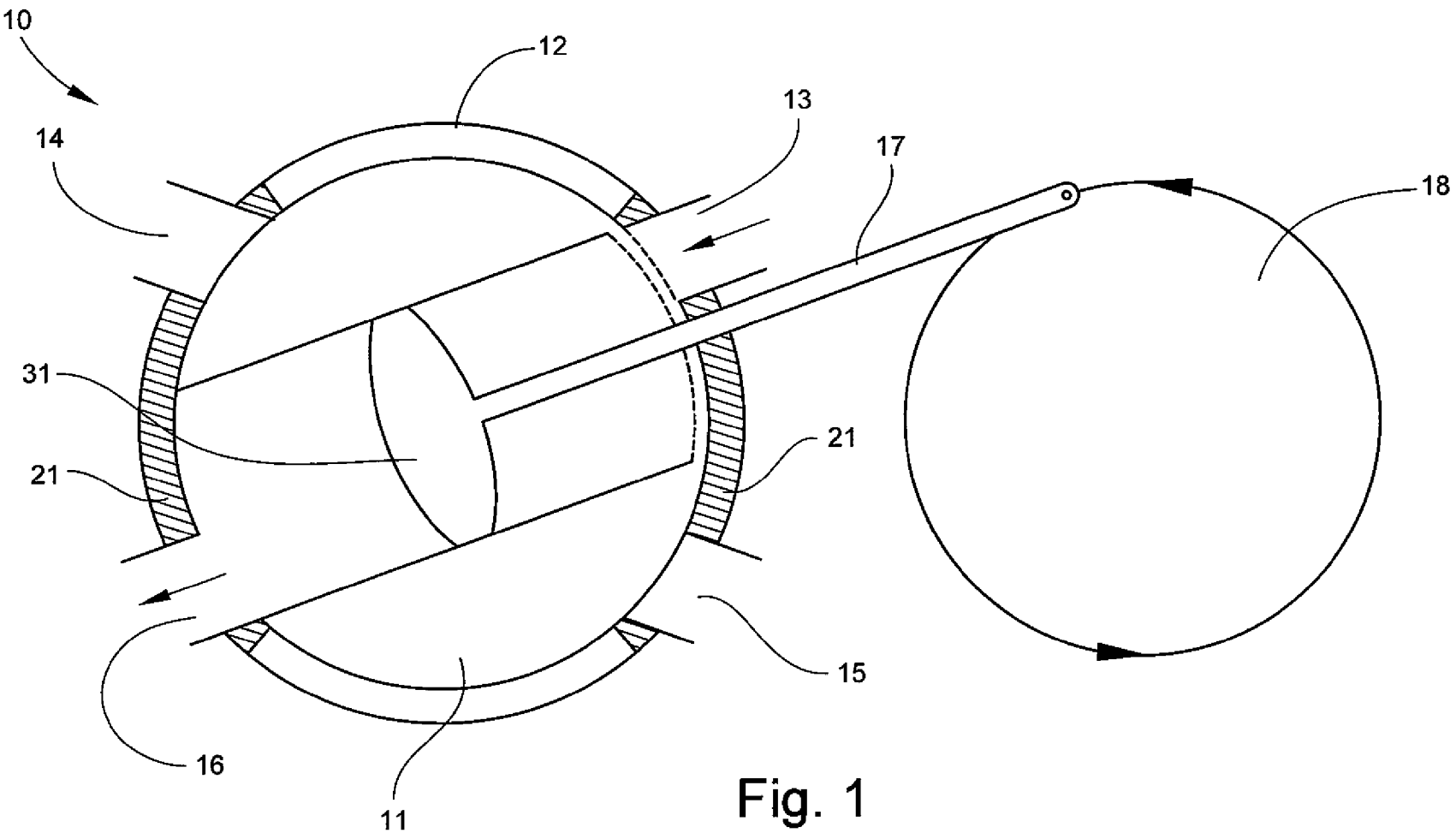
FIG. 1 is a schematic view of a cylinder assembly sealed with a resilient housing lining according to one embodiment of the invention.

A cylinder assembly incorporating an explicit seal according to the invention is illustrated in FIG. 1, and shown generally at reference numeral 10. The cylinder assembly 10 comprises an open end cylinder 11 inside an embracing housing 12, which also serves as a sealed container. The term "cylinder" as used throughout this application refers generally to a solid object having a chamber in which a piston moves, and is not intended to be limited to any particular shape.

The housing 12 preferably defines two entrance ports 13, 14 and two exit ports 15, 16, and a slot 23, shown in FIG. 2C, through which a piston rod 17 connected to a crank 18 is inserted that allows for oscillating movement of the piston rod 17.

The cylinder assembly 10 has an explicit seal 21 comprising a resilient lining bridging a non-sealing gap between the cylinder 11 and its embracing housing 12. The lining of the seal 21 can completely fill the gap, or it can only be in that portion from which leaks can occur. FIG. 1 illustrates the seal lining 21 being used in the vicinity of the assembly ports 13, 14, 15, 16 and the open ends of the cylinder 11. The seal lining 21 preferably is resilient enough to maintain an effective seal for the temperature variations and for the pressure differentials required of the assembly 10. The lining 21 should also have sufficiently low friction with the moving cylinder that operation of the assembly 10 is not unduly impeded. For many applications, a Teflon based lining can be used. The Teflon based lining may be used in conjunction with a very smooth and polished cylinder.

A related alternative to having a stationary sealing lining 21 bonded to, or fitting with, the housing 12 embracing the cylinder 11 would be to have a resilient sealing jacket or coating bonded to, or fitting with, the outside of the cylinder 11. As with the lining, the jacket could be complete or just sufficient to seal the cylinder ends and the housing ports 13, 14, 15, 16 for all positions of the cylinder 11. In this case, the inside of the housing 12 against which the jacket presses may be smooth and polished. This alternative would generally be less preferred, because it would add mass to the moving part of the assembly 10.

The cylinder 11 of the simplest assembly 10 is shown in perspective in FIG. 2A, and as viewed from the crank 18 in FIG. 2B. The cylinder 11 is open at both ends except for an alignment band 19 shown in FIG. 2B for the crank-side end through which the piston rod 17 slides. The band 19 keeps the barrel of the cylinder 11 in line with the piston rod 17 as it moves with the crank 18 and it serves to seal the slot 23 in the housing 12, shown in FIG. 2C, through which the piston rod 17 must move. FIGS. 2A and 2B show the cylinder 11 with trunnions 24 for the use of bearings. As the crank 18 turns, the cylinder 11 rotates alternately in clockwise and counterclockwise directions exposing the chamber of the cylinder 11 in turns to the crescent shaped intake and exit ports 13, 14, 15, 16. The working of this assembly 10 makes use of the fact that each direction of piston travel coincides with the crankpin being either above or below the center of the crank. This allows rotation of the cylinder 11 in conjunction with the movement of a one-piece piston head 31 and rod 17 such that the cylinder 11 itself opens and closes the appropriate ports 13, 14, 15, 16 at the appropriate times.

Figure 3A:
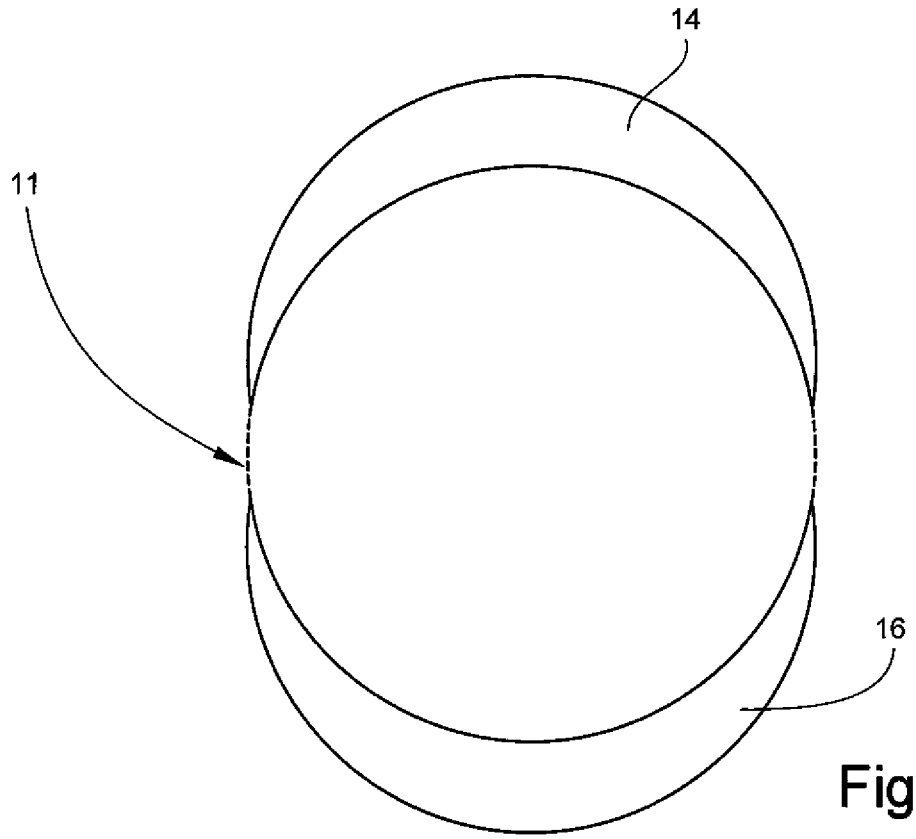
FIG. 3A is a left side plan view of the housing ports of the cylinder assembly of FIG. 1.
Figure 3B:
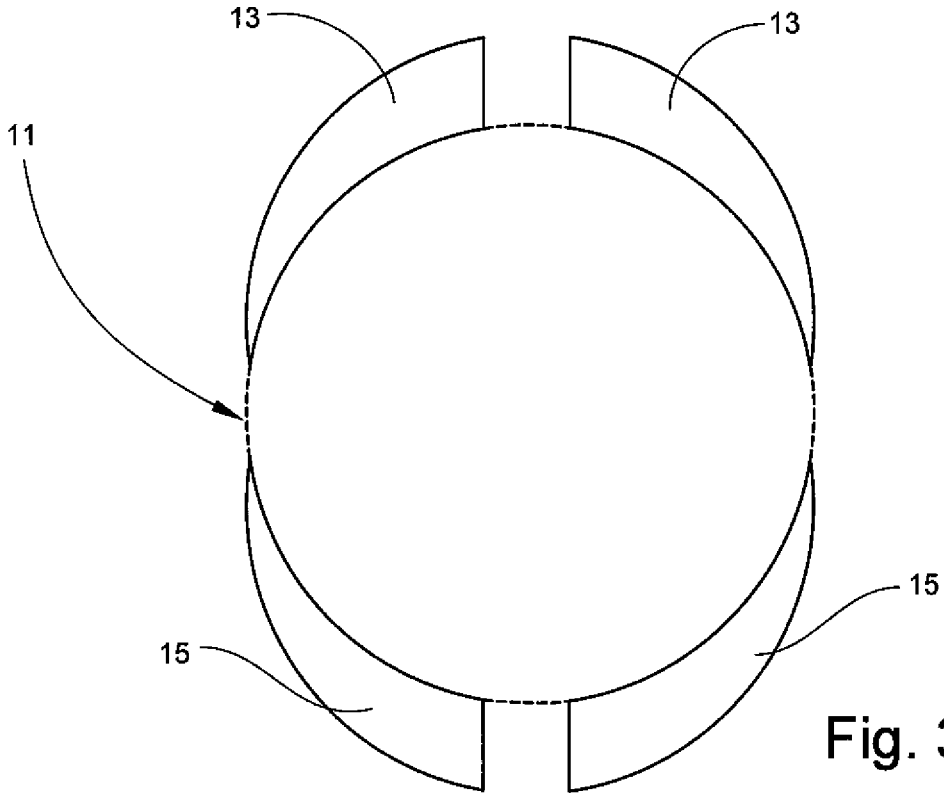
FIG. 3B is a right side plan view of the housing ports of the cylinder assembly of FIG. 1.

FIGS. 3B and 3A show the crank-side ports 13, 15 and opposite side ports 14, 16, respectively, from the view of the barrel of the cylinder 11, when the piston head 31 is at the nearest and furthest extent from the crank 18, which coincides with the direction reversal points of the piston 17. The outline of the barrel of the cylinder 11 at those piston positions is shown partially in phantom in FIGS. 3A and 3B. The ports 13,15 for the crank-side are shown as segmented around the position of the alignment band 19. As shown in FIG. 2B, the portion of the alignment band 19 around the piston rod hole 30 can be enlarged for strength and to provide a seal around the piston rod 17. Seals around the piston rods 17 in assembly 10 can be similar to those used around piston rods in traditional steam engines.

Figure 4:
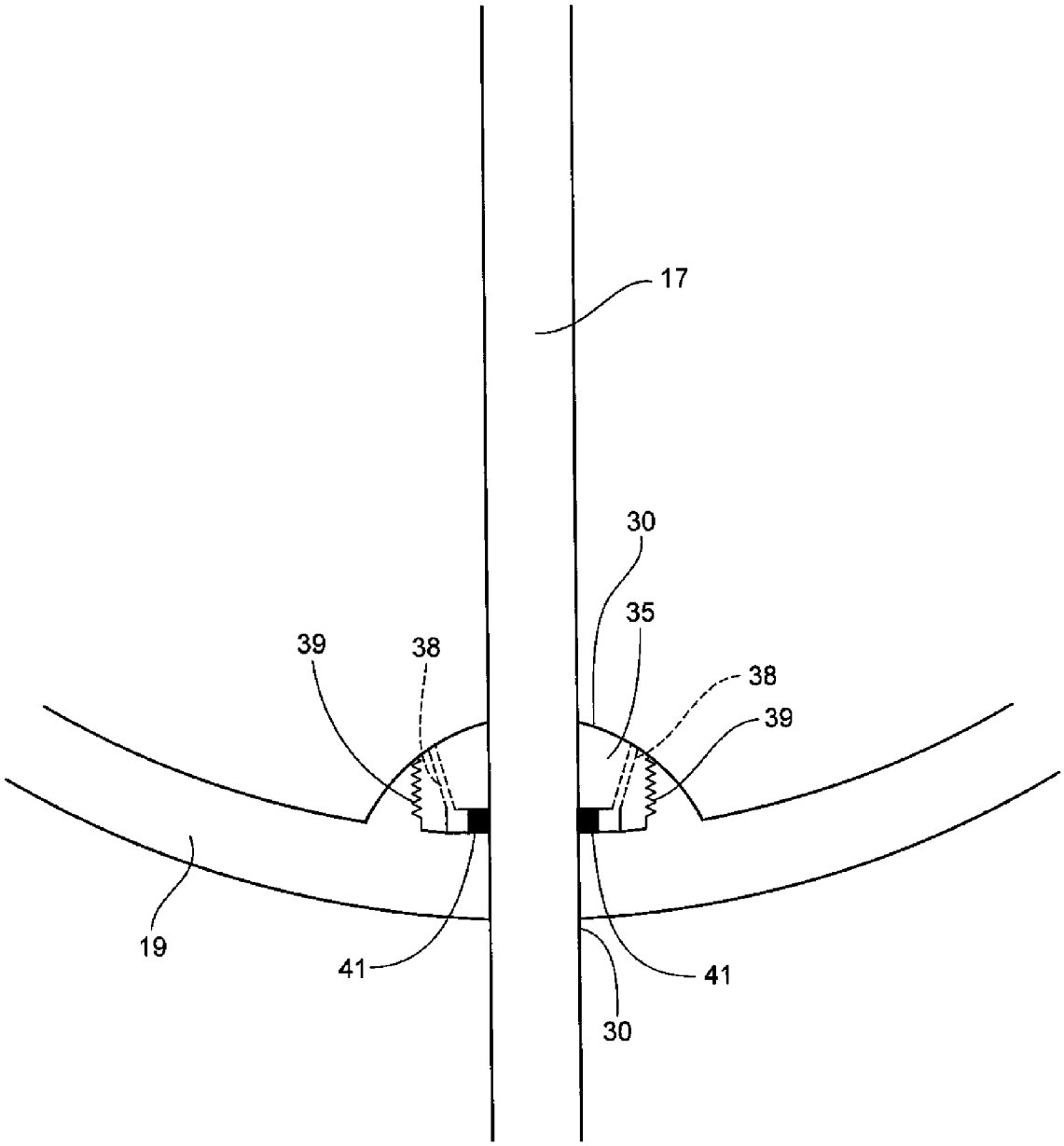
FIG. 4 is a cross sectional view of a piston rod sealing assembly according to the invention.

FIG. 4 illustrates a piston rod seal assembly according to the invention. The piston rod hole 30 goes through a plug 35 and the alignment band 19, which are fitted together, preferably with threads 39 to form a cavity around the piston rod 17 into which a sealing ring 41 can be placed. The sealing ring 41 can be made of a resilient material or it can be similar to conventional piston type rings except that it should be manufactured so as to press inward. Preferably, passages 38, shown in phantom in FIG. 4, are provided to allow high pressure from the cylinder 11 to reach the backside of the ring 41 so that it can engage the rod 17 with greater force when pressure is high.

The plug 35 can be made of a material more resistant to seizing with the rod 17 and have a tighter clearance around the rod 17 so as to more effectively transmit the oscillating movement to the cylinder 11.

Figure 5B:
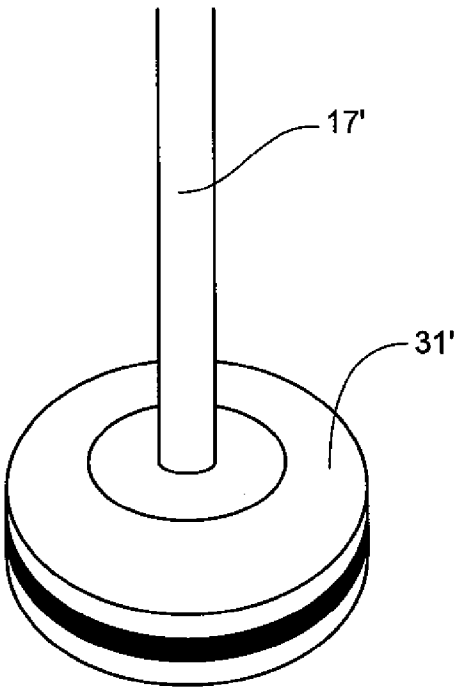
FIGS. 5A-B are perspective views of a matching cylinder and piston according to one embodiment of the invention.
Figure 5A:
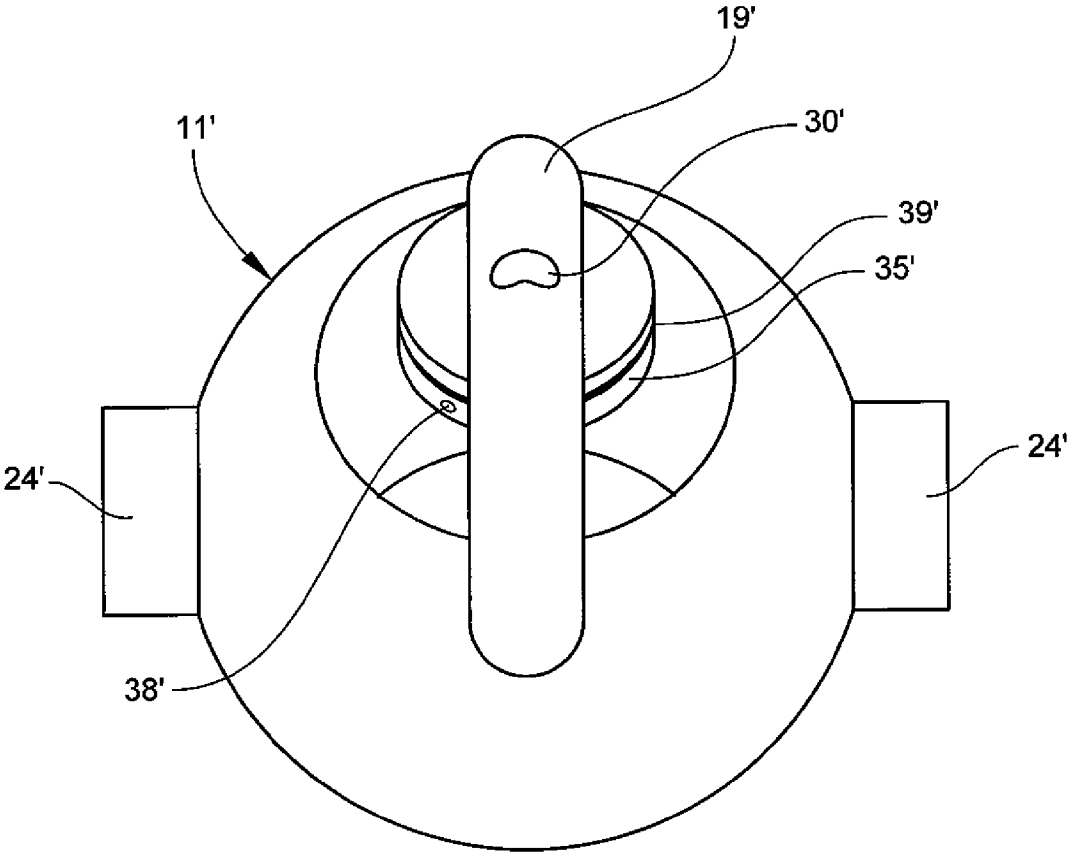

As shown in FIGS. 5A and 5B, part, or all, of the alignment band 19' can be external to the outside sphere of a cylinder 11'. In that case, the alignment band 19' fits into a receiving groove in the housing. The advantage of keeping any enlargement of the band 19' around the rod hole 30' inside the sphere of the cylinder 11' is that the external portion of the band 19' can then be made of uniform width so as to fit uniformly and tightly into the housing receiving groove. Away from the rod hole 30', the band 19 need not be especially wide, though it must be wide enough to seal the slot in the housing through which the piston rod 17' moves. A narrower band 19 permits more space for porting on the crank side.

Figure 6B:
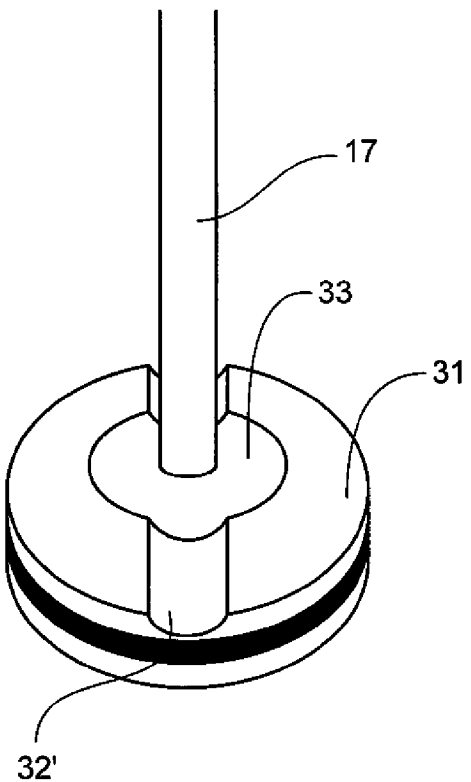
FIGS. 6A-B are perspective views of a matching cylinder and piston according to another embodiment of the invention.
Figure 6A:
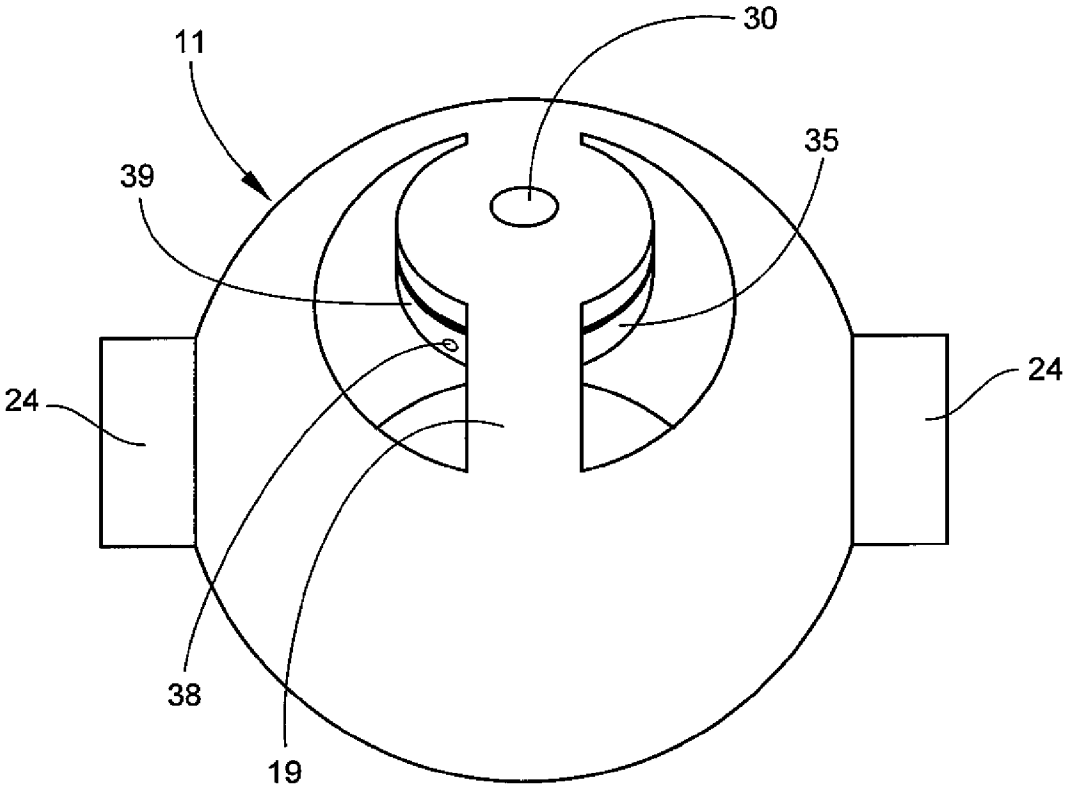

FIGS. 6A and 6B show perspective views of the cylinder 11 and mating piston head 31 where the alignment band 19 is completely inside the cylinder sphere 11. Regardless of the configuration of the alignment band 19, the portion of the band 19 inside the cylinder sphere 11 can be made to fit into a receiving groove 32 on the crank side of the piston head 31, shown in FIG. 6B. The dome of the plug 35 mounted on the interior side of the band 19 around the piston rod hole 30 can fit into a pocket 33. By mating the shape of the crank-side piston head 31 to any portion of the band 19 inside the cylinder sphere 11, dead space at the end of the piston throw can be largely eliminated.

Figure 7A:
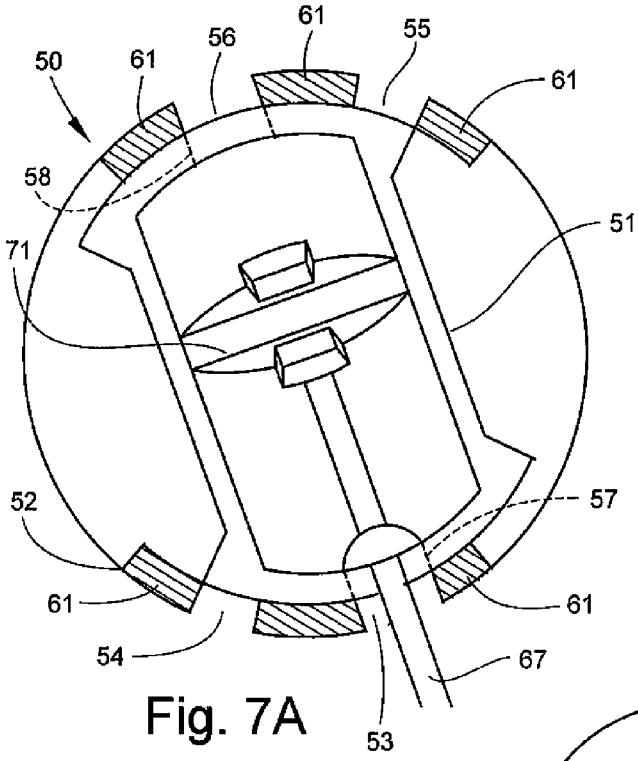
FIG. 7A is a cross sectional view of an cylinder assembly with a resilient housing lining according to another embodiment of the invention.
Figure 7B:
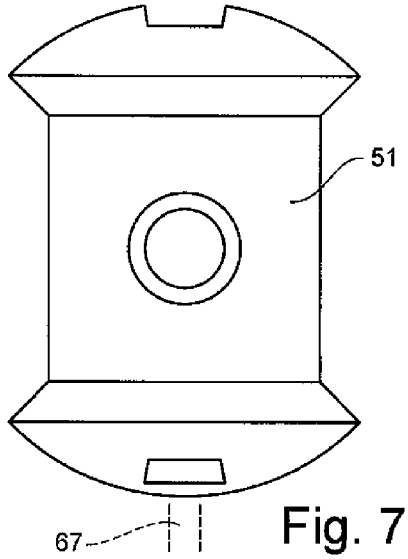
FIG. 7B is a top plan view of the cylinder of the cylinder assembly of FIG. 7A.
Figure 7D:
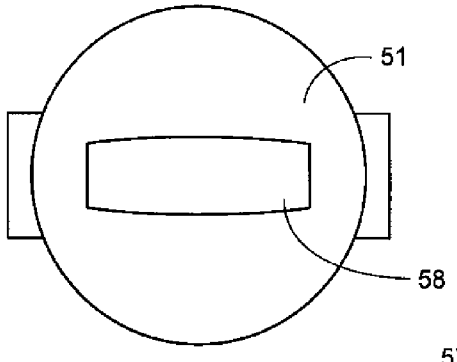
FIG. 7D is a top elevation of the cylinder of FIG. 7A.
Figure 7C:
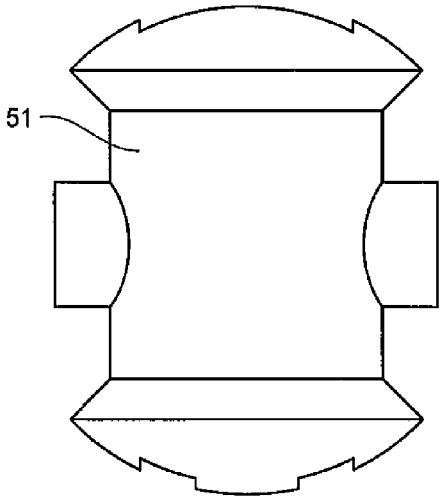
FIG. 7C is a side elevation of the cylinder of FIG. 7A.
Figure 7E:
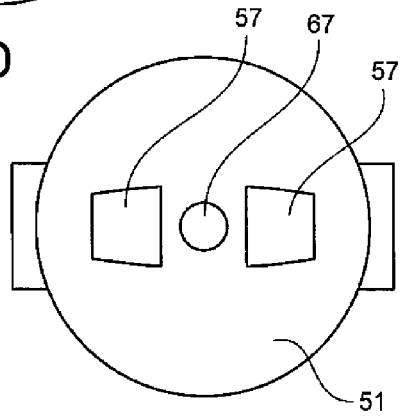
FIG. 7E is a bottom elevation of the cylinder of FIG. 7A.

An alternative cylinder assembly 50 with a resilient lining seal 61 is shown in FIGS. 7A through 7E. The cylinder assembly 50 comprises a cylinder 51 inside an embracing housing 52. The ends of the cylinder 51 are closed except for roughly rectangular shaped openings 57, 58 which alternately line up with two pairs of generally similar shaped ports 53, 54 and 55, 56, respectively, in the housing. In FIG. 7A, the piston head 71 is not shown in cross section for simplicity and to highlight its shape. The location of the openings 57, 58 in the ends of the cylinder 51 is shown in phantom in FIG. 7A. With larger scales, the assembly 50 would be easier to manufacture, as well as lighter. Easy assembly may require that the cylinder 51 be made of more than one part.

With higher pressure differentials, simple resilient linings or jackets are likely to be less effective seals. Sufficient pressure against the cylinder by a lining or against the housing by a jacket, to restrain the leakage of high pressure, may at some point begin to unduly hamper the movement of the cylinder. The nature of the assembly does not particularly lend itself to seals which provide high sealing pressure over a small area of contact. That is because it is not only the cylinder ends which must remain sealed, but also the ports, particularly the highest pressure ports. Where extremely high pressures must be restrained, a sealing arrangement, which engages with more force with higher pressure, is likely to be more successful. High sealing pressure would not then be a continuous drag on operation of the assembly 10, but would only be brought to bear when most needed. Even where high pressures are continuously maintained, as with steam engines, having the seals be pressure activated means the sealing forces are determined by the pressure and are not affected by slight clearance variations in manufacture, from wear, or due to temperature variations in the parts of the assembly.

Figure 8:
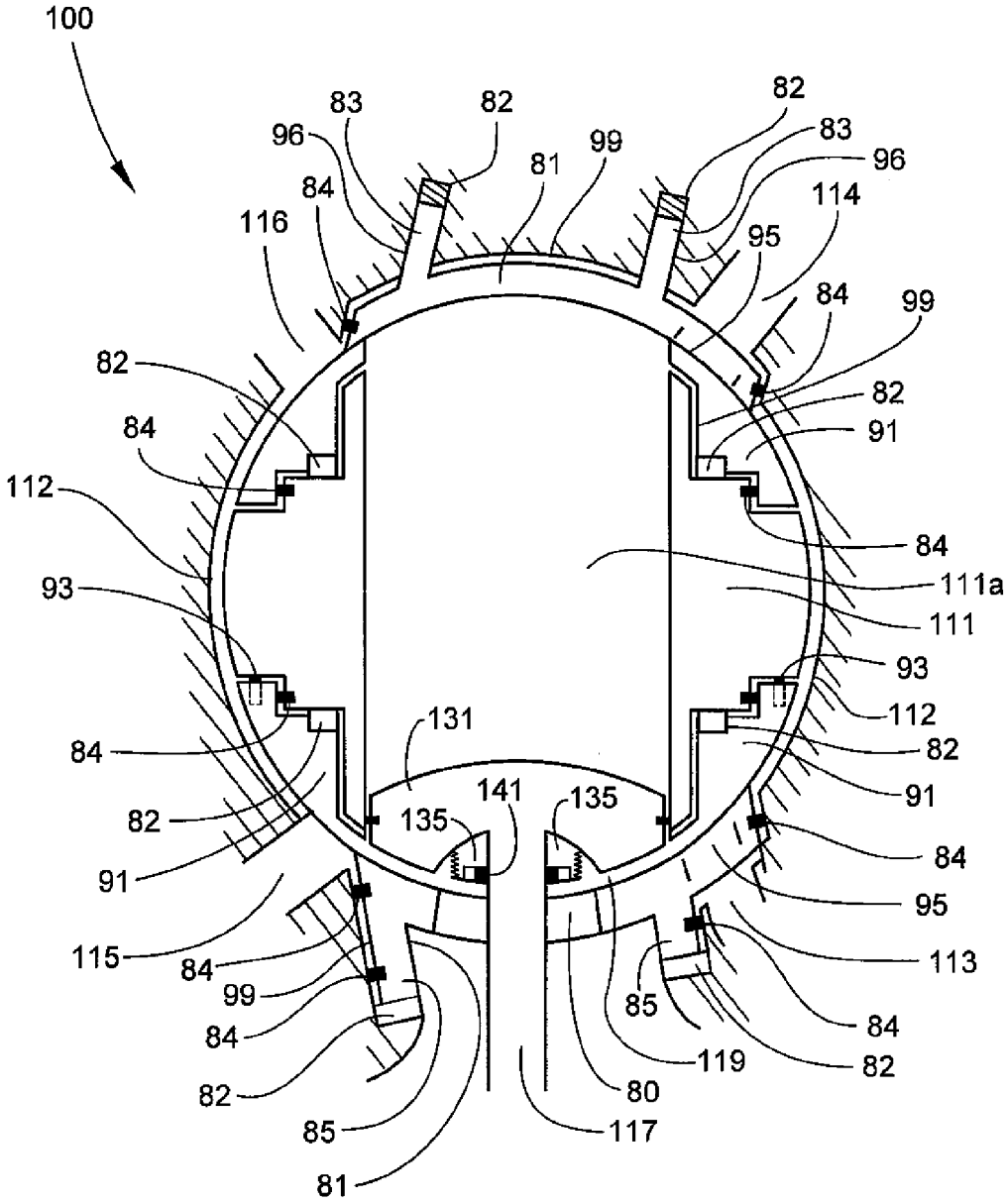
FIG. 8 is a cross sectional view of a cylinder assembly with mechanical seals on the cylinder ends and in the embracing housing according to another embodiment of the invention.
Figure 9A:
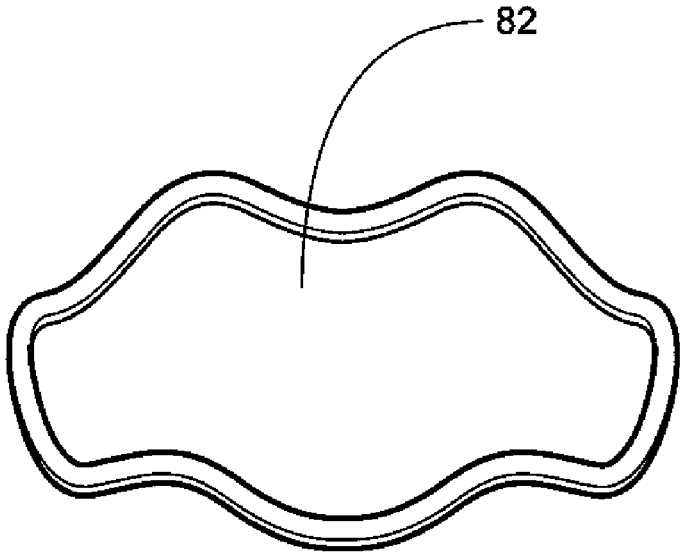
FIG. 9A is a perspective view of a wavy form spring ring according to the invention.
Figure 9B:
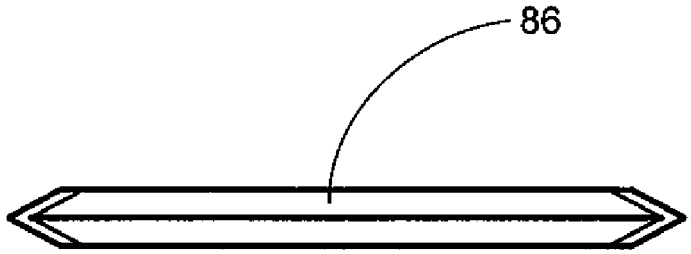
FIG. 9B is a cross sectional view of a spring ring with a 'V' shaped cross section according to the invention.

FIG. 8 illustrates another alternative assembly 100, in which the assembly 10 of FIGS. 2-6 has been modified to include pressure activated mechanical (or non-resilient) seals 81, 91 in the housing 112 and on the cylinder 111, respectively. Part of the housing 112 surrounding the high pressure ports 113, 114 and including all the housing area which covers the cylinder barrel ends at the neutral point where none of the ports 113, 114, 115, 116 are active, is made movable so as to be able to press tightly against the cylinder 111. High pressure is allowed to enter the crevice between the moveable and fixed portions of the housing 112 so as to press the movable parts, housing seals 81 against the cylinder 111. Contact against the cylinder 111 is maintained by springs 82, even when pressures are low. As shown in FIG. 8, the crank side housing seal 81 can include a spring 82 in the shape of a wavy form ring. A perspective view of such a wavy form spring 82 is shown in FIG. 9A. Alternatively, a spring ring 86 with a 'V' shaped cross section, such as shown in FIG. 9B could be used.

As shown in FIG. 8, coil springs 82 push against alignment pins 83 on the back side of the non crank-side housing seal 81. The pins 83 are positioned in holes 96 in the housing 112, and serve to keep the sides of that seal aligned with the matching sides in the housing 112. They also serve to prevent the seal 81 from rotating such that the port 95 in the seal 81 is not aligned with the port 114 in the housing 112. The location of the porting 95 through the seals 81 and the housing 112 is shown in phantom. High pressure is prevented from blowing by the sides of the seals 81, into the gap between cylinder 111 and housing 112, by one or more piston-type rings 84 fitting into one or more grooves in the sides of the seals 81 and pressing against the side of the pocket in the fixed housing 112 into which the seals 81 fits. For the housing seal 81 on the crank end of the assembly 100, the seal 81 has one or more additional rings 84 around the pipe-like extension 85 of the seal 81 to prevent blow-by around the seal 81 into the space of the crank 118. The crank end housing seal 81 is prevented from rotating within its pocket in the housing 112 by the back and forth movement of the piston rod 117 and the fact that the two rings or sets of rings 84 do not share the same center. The crank end housing seal 81 has a slot 80 for passage of the piston rod 117.

Figure 10A:
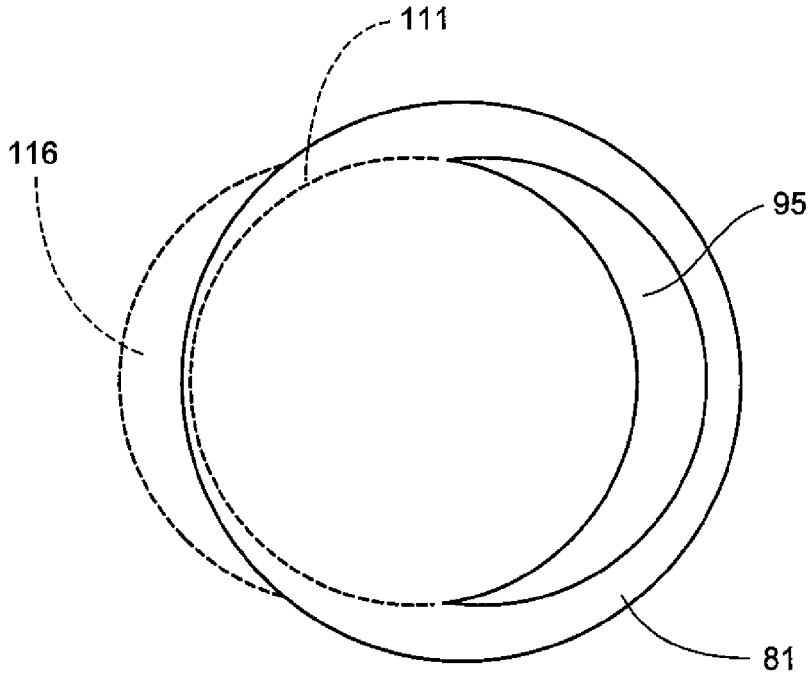
FIGS. 10A-B are front elevations showing the housing seal faces and the positions of the fixed housing ports of the cylinder assembly of FIG. 8.
Figure 10B:
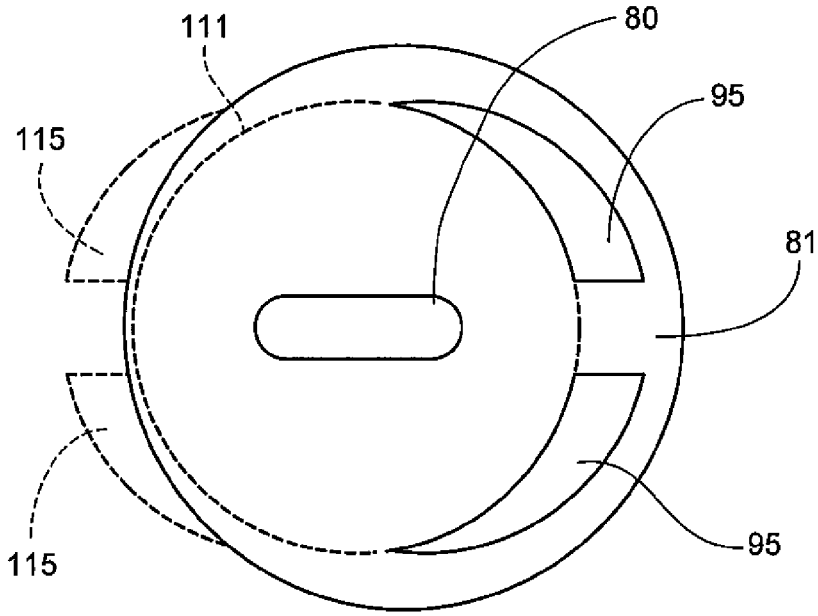
Figure 11A:
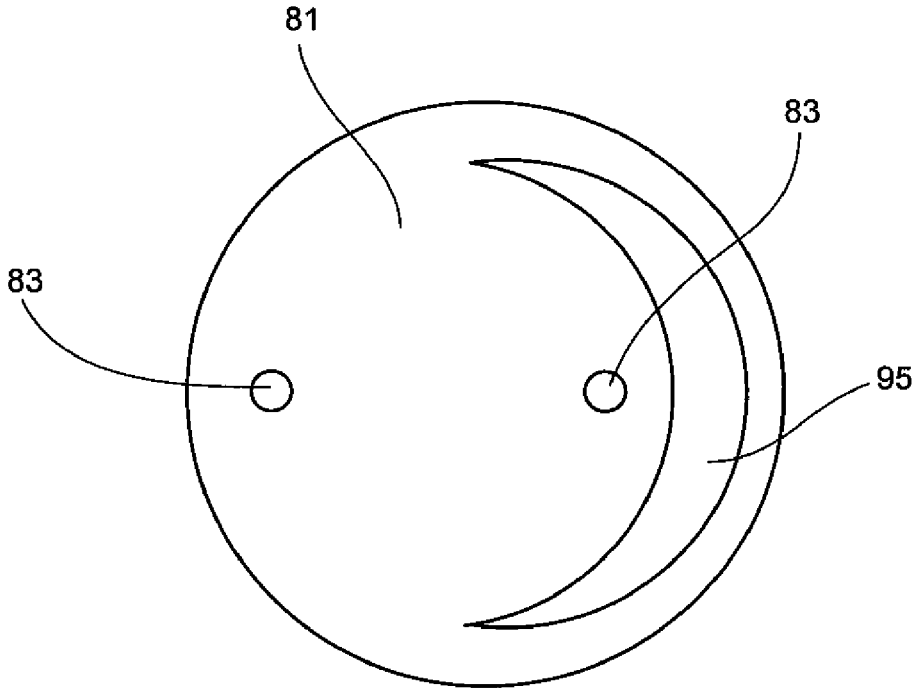
FIGS. 11A-B are rear elevations of the housing seals of FIGS. 10A-B.
Figure 11B:
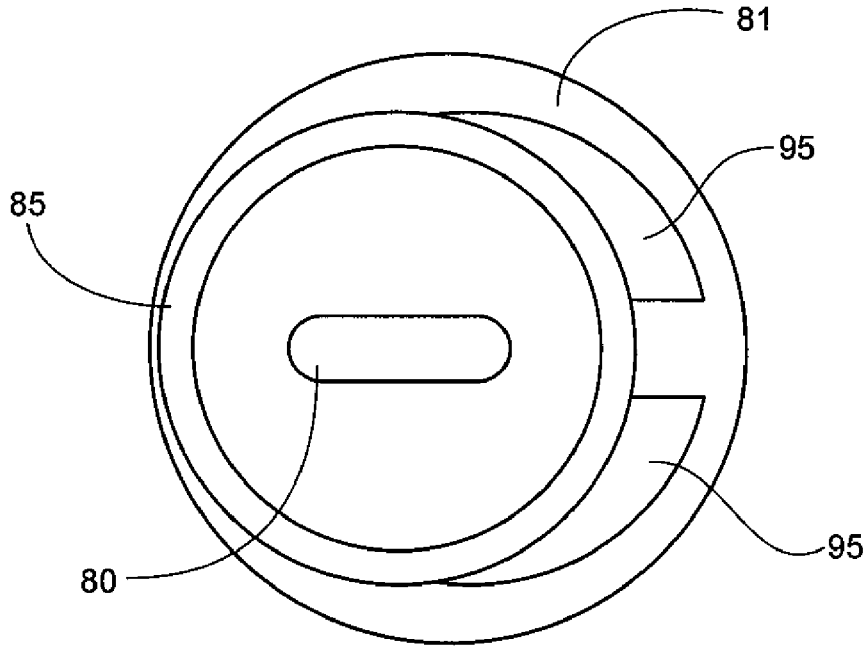

Elevations of the seals as viewed from the center of the assembly 100 are shown in FIGS. 10A and 10B for the non-crank and crank sides, respectively. The high pressure ports 95 go through the seals 81, while the low pressure ports 115, 116 are in fixed portions of the housing 112. The positions of the low pressure ports 115, 116 and of the barrel of the cylinder 111 at 'top dead center' and 'bottom dead center' are shown in phantom in FIGS. 10A and 10B. Elevations of the backsides of these seals 81 are shown in FIGS. 11A and 11B.

In addition to the housing seals 81 are cylinder end seals 91 which serve to maintain sealing force should the pressure in the cylinder 111 approach or exceed the pressure in the cavities behind the housing seals 81. The latter condition may occur if the assembly 100 were used to compress a gas. These cylinder end seals 91 are separated from the cylinder 111 by a crevice space open to the barrel of the cylinder 111. Another set of piston-type rings 84 separates those crevice spaces from the cylinder-housing gap. High pressure in the cylinder 111 can force the cylinder end seals 91 against the housing seals 81. When pressure within the cylinder 100 is low, contact between the two types of seals can be partially maintained by additional wavy form ring springs 82 of the type shown in FIG. 9A.

The crank end cylinder seal 91 is particularly complicated. It must incorporate the alignment band 119, which is shown in FIG. 8 fitting into a groove on the bottom side of the piston head 131. Into the top of the alignment band 119 must fit the piston rod seal 141 and plug 135. Because the alignment band 119 must seal the slot 180 for the piston rod 117, the cylinder end seal 91 must not rotate. That can be accomplished by pins 93 on the cylinder 111 fitting into holes in the crank end cylinder seal 91, as shown in FIG. 8.

Figure 12A:
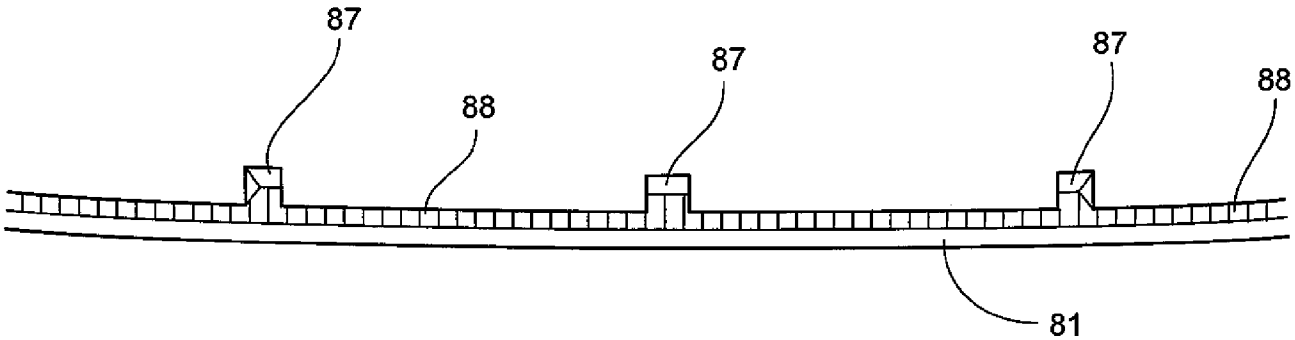
FIG. 12A is a perspective edge view of notches in the ring grooves serving to bring high pressure to the ring's backsides according to the invention.
Figure 12B:
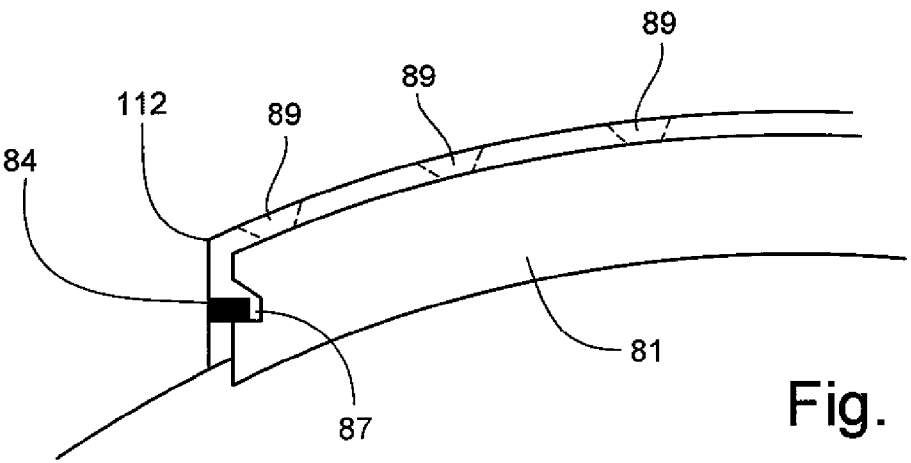
FIG. 12B is a cross sectional view of a notch and bumps in the high pressure crevice space.

As shown in FIGS. 12A and 12B, the grooves 88 in the sides of the housing seals 81 for the piston type rings 84 could have evenly spaced notches 187 cut on the high pressure side for the purpose of bringing high pressure to the backside of the rings 84 so as to increase the push of the rings 84 against the fixed housing 112. The housing 112 can also have appropriately placed bumps 89 on it to prevent the seals 81 from completely closing off the crevice spaces. Such bumps 89 are illustrated in phantom in FIG. 12B. The cylinder 111 can also have notches 87 bringing pressure to the backside of the rings 84 and bumps 89 insuring the openness of the crevice spaces between the cylinder 111 and the cylinder end seals 91. Liberal use of bumps 89 in the crevice spaces could be used to minimize the volume of the crevice spaces 99 while still keeping them open to flows and without great loss of the surface area against which the high pressure pushes.

Mechanical seals can have a face made of a composite, such as carbon, graphite or ceramic fibers, pressing against a hard surface. Since this assembly 100 has mechanical seals facing each other, it is preferable that one of the seal faces be comprised of some such composite and that the other face is comprised of a compatible hard material. It should be noted that while the invention of this application comprises the mechanics of the seals, the suitable materials for the seals can vary depending on the use demands of the particular assemblies.

It is also notable that although the cylinder/mechanical seal assembly 100 of FIGS. 8-12 preserves the simple overall shape of the assembly 10 presented in FIGS. 1-6, the individual parts are quite complicated, especially as noted above, the crank end cylinder seal 91. Another disadvantage is that only part of the crevice spaces between the cylinder 111 and the cylinder end seals 91 are such that they push those seals against the housing seals 81. The remainder of the volume of those crevice spaces is 'wasted'. A further drawback is that working of the high pressure behind the housing seals 81 is partially defeated once high pressure is allowed to enter the cylinder chamber 111*a* and thereby be on both sides of the housing seals 81. As noted above, this would be even more of an issue where the high pressure is developed within the cylinder chamber 111*a*, such as with compression. With high pressure on both sides of the housing seals 81, only a surface area larger behind the seals 81 than that exposed to the inside of the cylinder chamber 111*a* would provide a net push in the required direction.

An assembly with mechanical seals more akin to the assembly of FIG. 7 would generally be preferred. Such an assembly is shown in cross section in FIG. 13, and shown generally at reference numeral 150. Here the cylinder ends are mechanical seals 161*a*, 161*b*. Leakage from the chamber 151*a* of the cylinder 151 past the end seals 161*a*, 161*b* is prevented by single or multiple piston type rings 184 fitting into grooves on the outside of the cylinder barrel 151 and pressing against a cylindrical surface inside the edge of the seals 161*a*, 161*b*. These cylinder end seals 161*a*, 161*b* press against housing seals 181*a*, 181*b* fitting into pockets in the housing 152. The cylinder end seals 161*a*, 161*b* are prevented from rotating around the cylinder barrel 151 by pins 183 on the cylinder barrel 151 which fit into matched notches on the outside edge of the cylinder end seals 161*a*, 161*b*. This is one means for preventing the rotation of the seals 161*a*, 161*b*.

Regardless of the means used, the clearances can be designed such that the oscillatory movement is transferred by such means from the seal 161*b* to cylinder 151 rather than having the piston type rings 184 perform that function. The housing seals 181*a*, 181*b* could also have their side to side movement in their housing pockets limited by similar means rather than by the piston type rings 184.

Figure 15A:
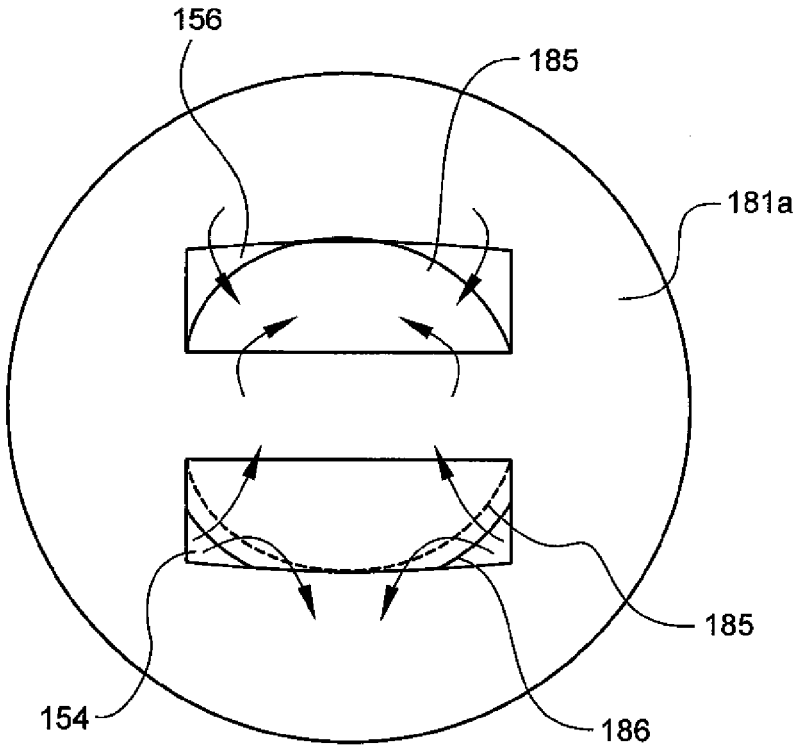
FIGS. 15A-B are face elevations of the non-crank and crank housing seals of the cylinder assembly of FIG. 13.
Figure 15B:
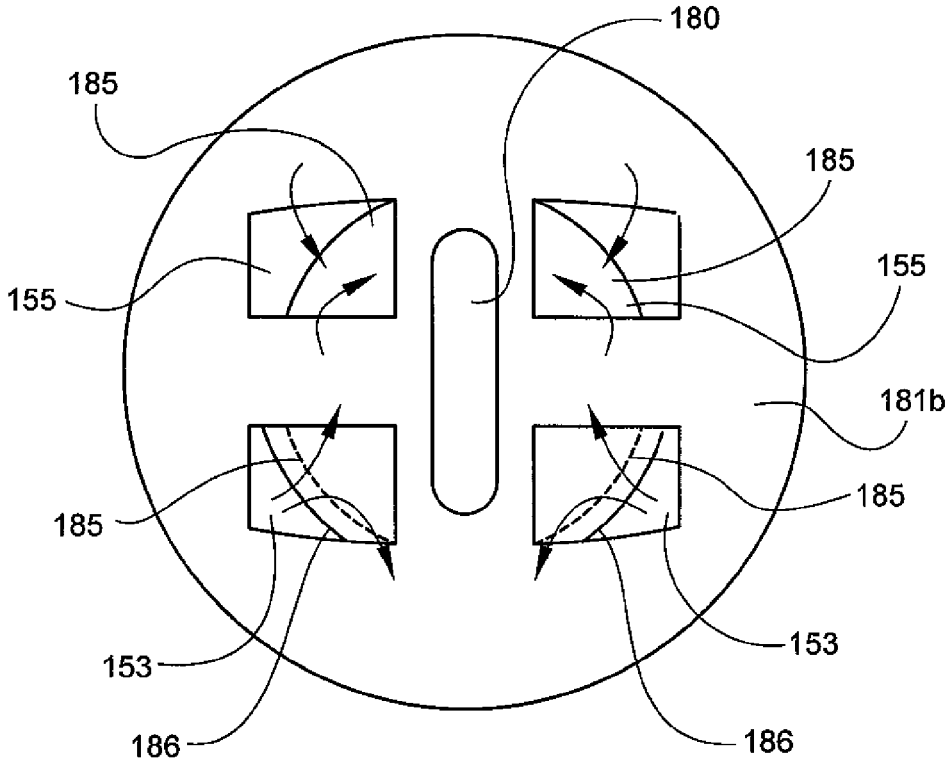
Figure 16A:
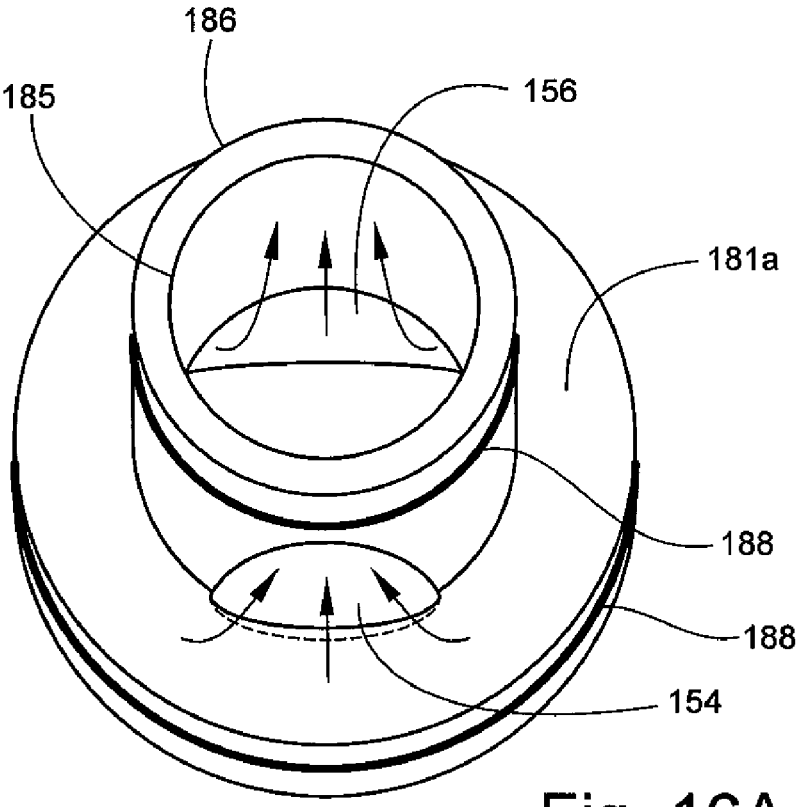
FIGS. 16A-B are perspective views of the back sides of the non-crank and crank housing seals of the cylinder assembly of FIG. 13.
Figure 16B:
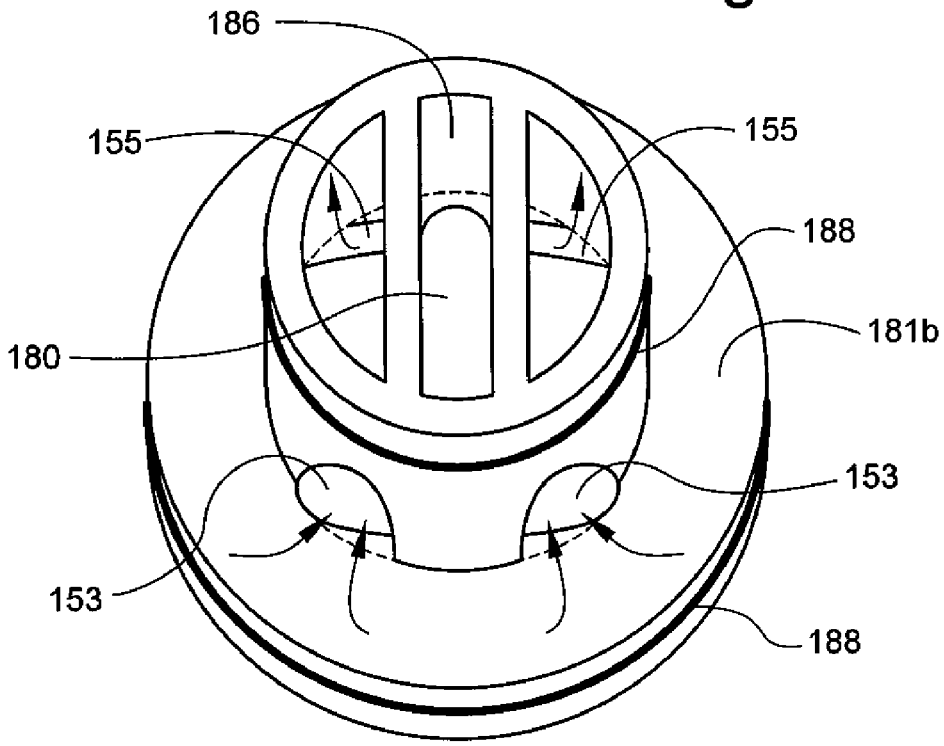
Figure 17:
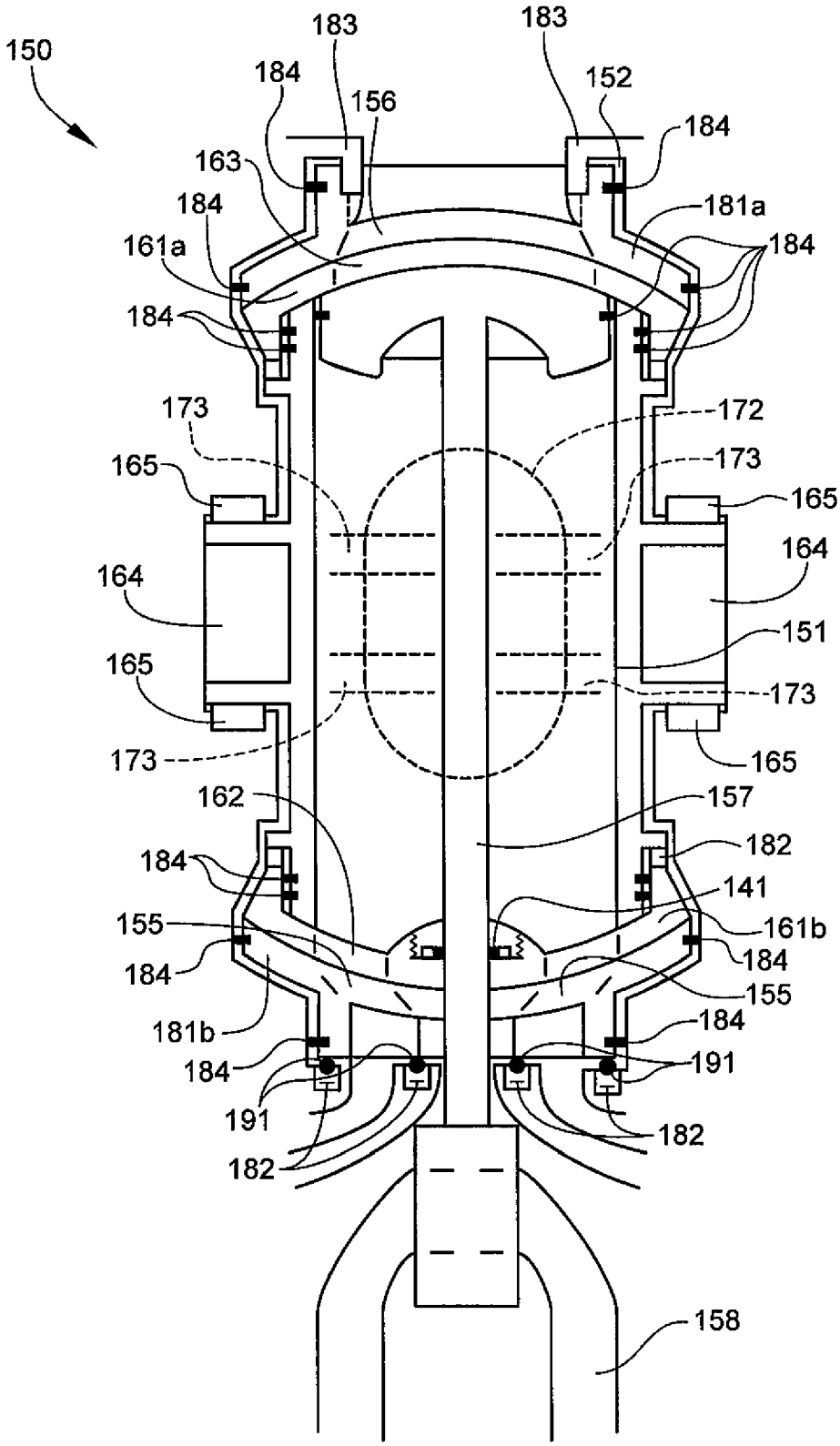
FIG. 17 is another cross sectional view of the cylinder assembly of FIG. 13.

Between the cylinder barrel 151 and the cylinder end seals 161*a*, 161*b* are wavy form springs 182 pushing the end seals 161*a*, 161*b* against the housing seals 181*a*, 181*b*. The location of the ports 162, 163 in the seals 161*a*, 161*b* and the location of the ports 153, 154 in the housing 152 are shown in phantom in FIG. 13. So as not to obscure the shape of the seal 181*b* and the location of the ports 153, 155 in the crank-end housing seal 181*b*, the slot 180 that the piston rod 157 slides in is not shown in FIG. 13. The position of the slot 180 is shown in FIGS. 15B and 16B. Both housing seals 181*a*, 181*b* show two sets of piston type rings 184. One set seals the crevice spaces from the space between the cylinder 151 and the housing 152. The other set of rings 184 seals the crevice spaces from the lower pressure port or manifold or, at the crank end, from the crankcase or crank area. The low pressure crank end porting 155 can be done through the crankcase or, as shown in FIG. 17, through immediate additional 'plumbing' with additional seals.

Figure 13:
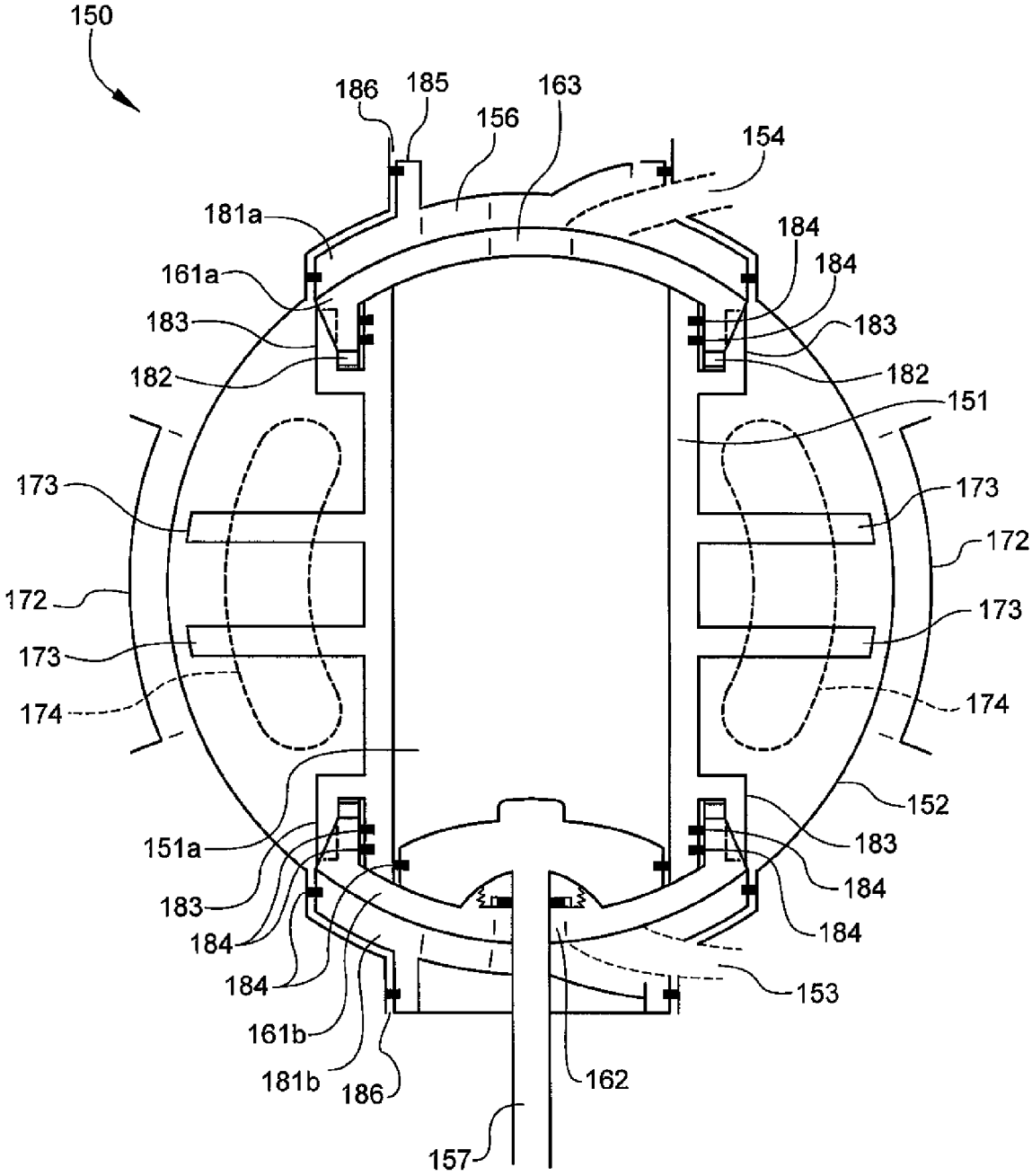
FIG. 13 is a cross sectional view of a cylinder assembly with mechanical seals according to another embodiment of the invention.
Figure 14A:
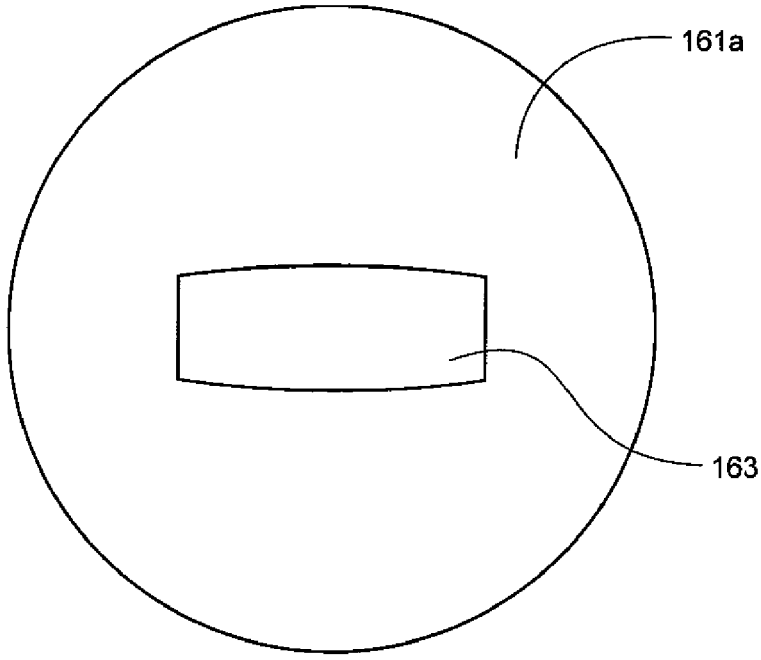
FIGS. 14A-B are face elevations of the non-crank and crank cylinder end seals of the cylinder assembly of FIG. 13.
Figure 14B:
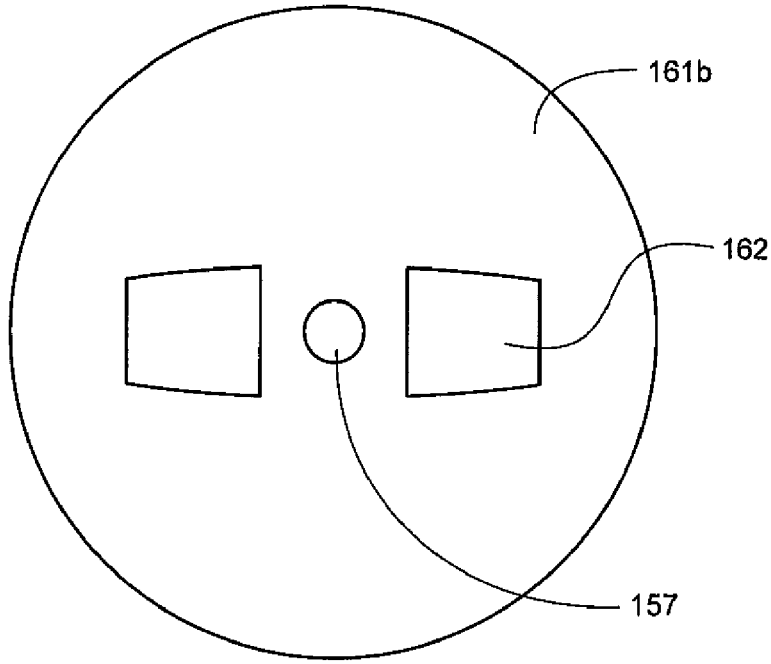

Elevations of the faces of the cylinder end seals 161*a*, 161*b* are shown in FIGS. 14A and 14B. Elevations of the faces of the housing seals 181*a*, 181*b* pressing against the cylinder end seals 161*a*, 161*b* are shown in FIGS. 15A and 15B. Perspective views of the backsides of the housing seals 181*a*, 181*b* are shown in FIGS. 16A and 16B. The location of grooves for holding piston-type rings 184 are shown at reference numeral 188. The arrows of FIGS. 15A-B and FIGS. 16A-B show the direction of flow through the ports 153-156 of the housing seals 181*a*, 181*b* for the case where high pressure enters the cylinder/seal assembly 150 from outside, as in a traditional steam engine. If the assembly 150 were used in a compressor, the direction of the flows would be reversed. The high pressure flows enter the cylinder 151 from the outside 186 of the pipe-like extension of the housing seals 181*a*, 181*b*. The low pressure flows exit the cylinder 151 through the inside 185 of the pipe-like extensions. The crank-end housing seal 181*b* is prevented from rotating within its pocket by the side to side movement of the piston rod 157 in its slot 180 in that housing seal 181*b*. The non-crank end housing seal 181*a* can be prevented from rotating by pins 183 and notches as shown in FIG. 17. No springs are shown in FIG. 13 for the housing seals 181*a*, 181*b*; however, they could be added if needed. As the crank 158 turns, the port 163 in cylinder end seal 161*a* and the port 162 in cylinder end seal 161*b* are alternately revealed to the high pressure ports 153, 154 and the low pressure ports 155, 156 in the housing seals 181*b*, 181*a*. The faces of the cylinder end seals 161*a*, 161*b* are shown as round in FIGS. 14A and 14B, however, they can be of any suitable shape. They could, for example, be wider in the direction of their back and forth movement to provide more sealing surface around the ports 153-156 in the housing seals 181*a*, 181*b*. The faces of the housing seals 181*a*, 181*b* shown in FIGS. 15A and 15B, however, should be round as long as piston type rings 184 are used to seal around their circumferences.

When high pressure exists within the cylinder 151 it presses with maximum area directly against the cylinder end seals 161*a*, 161*b* in the desired direction and with virtually no wasted crevice space. Additionally, high pressure forces within the crevice spaces between the housing 152 and the housing seals 181*a*, 181*b* are little defeated by high pressure within the cylinder chamber 151*a* working on the other side of the seals 181*a*, 181*b*.

This assembly 150, unlike the assembly 100 of FIG. 8, has no working flows in the space between the housing 152 and cylinder 151. As such it is easy to use that space for another purpose. FIG. 13 illustrates that space being used to actively cool the cylinder barrel 151. Cooling fins 173 are shown added to the sides of the cylinder barrel 151. The rotational oscillations of the cylinder barrel 151 will cause the fins 173 to fan air, or other coolant, outward as with conventional hand held fans. Openings 172 on the housing 152 could permit the outward flow of that air. Cooling makeup air could be allowed in through openings 174 closer to the pivot point and trunnions 164 of the assembly 150. The location of such makeup openings 174 is shown in phantom in FIG. 13. In higher RPM applications, shorter cooling fins 173 may be preferred. It should be noted that this cooling mechanism would also work for the assembly 50 of FIG. 7. A liquid coolant could also be used. It is preferable, though, that the cylinder 151 not be immersed in a liquid coolant, because of the resistance that would give to the back and forth rotations of the cylinder 151. Coolant could be trickled on or sprayed on near the trunnions 164 and then, after being thrown off by the cylinder 151 due to 'centrifugal' force, cooled again. Such a cooling means might also use the same sprayed on coolant as a lubricant for the sealing interface, the bearings 165 surrounding the cylinder's trunnions 164, and the crank 158. In such a case the lubricant from the crankcase might be brought to the cylinder barrel 151*a* by passages in the piston rod 157 and piston head out to between two of the piston rings 184. FIGS. 13 and 17 only show single piston rings 184 around the piston head.

FIG. 17 shows the assembly 150 of FIG. 13 rotated 90 degrees along the axis of the piston rod 157. The piston 157 is shown with the crank 158 rotated 180 degrees from its position in FIG. 13. This position helps illustrate the possibility of providing lower pressure porting on the crank end separate from the crankcase or crank area.

FIG. 17 shows porting through the back side of the crank end housing seal 181*b*, but which does not obstruct the slot 180 through which the piston rod 157 must move. A 'D' shaped sealing ring 191 is shown being pressed against the housing seal 181*b* from the housing 152 by a wavy form spring 182. Here the wavy form spring 182 would also have a 'D' shape. The 'D' shaped surfaces on the housing seal 181*a* against which these 'D' rings press is shown in the perspective view of the housing seal of FIG. 16B. The 'D' ring seals 191 would have to be rigid or have separate or integral rigid backing so that the seal 191 can press uniformly against the surface of the housing seal 181*b*. As an alternative to the wavy form spring 182, a 'D' shaped spring with a 'V' cross section, as shown in FIG. 9B, could be used.

FIG. 17 is shown with the crank 158 closest to the cylinder assembly 150 to illustrate the requirement for clearance at that end. Clearance in FIG. 17 is shown at a minimum. A crank location consistent with the porting of the assembly 150 of FIG. 13 would actually have greater clearance than shown in FIG. 17. Larger rotational movement of the cylinder 151 and thus larger potential porting requires the crank 158 to be closer to the cylinder assembly 150. Smaller and simpler assemblies might do all the low pressure porting directly through the crankcase or crank area.

Figure 18A:
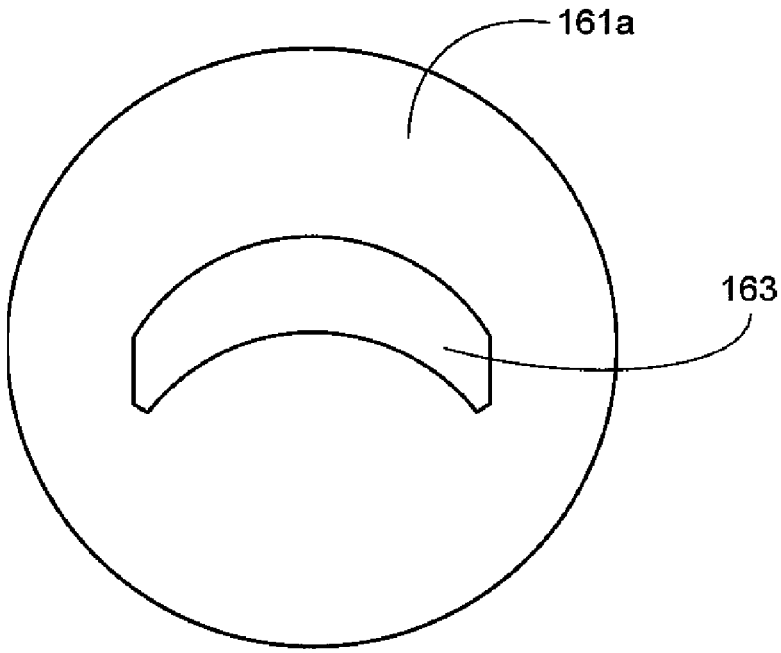
FIG. 18A is a face view elevation of a non-crank cylinder end seal according to another embodiment of the invention.
Figure 18B:
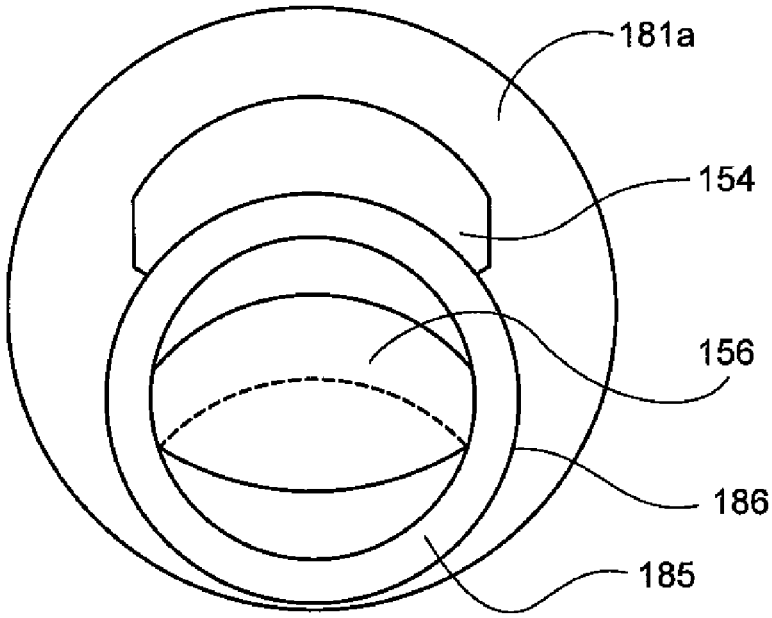
FIG. 18B is a backside elevation of a non-crank housing seal for use in conjunction with the cylinder end seal of FIG. 18A.

An alternative porting scheme for the non-crank end of this assembly 150 is shown in FIGS. 18A and 18B. Here the pipe-like extension of the housing seal 181*a* through which the lower pressure flows are ported is off center relative to the main body. The ports 154, 156 are substantially crescent shaped. The portion of the housing seal 181*a* between the active ports 154, 156 matches the port 163 in the cylinder end seal 161*a*. FIG. 18B shows the low pressure port 154 enlarged beyond the potentially active portion in order to eliminate a part of the seal 181*a* which would add mass but little strength. As in the other porting scheme, the back and forth movements of the cylinder end seal 161*a* alternately reveals the cylinder end seal port 163 to the high pressure 154 and low pressure ports 156 in the housing seal 181*a*. This scheme allows the high pressure porting to be done somewhat closer to the center of the cylinder assembly 150. This can be advantageous in some applications, especially in the internal combustion engines where compressed gases are passed from one cylinder assembly to another.

It has been noted that the mechanical seals 161*a*, 161*b* of the cylinder assembly 150 use pressure to press the sealing faces more forcefully together when pressure is high. Another force, informally referred to as centrifugal force, intermittently works to press the seals together. The cylinder end seals 161*a*, 161*b* rotate back and forth around the center pivot point of the assembly 150. While rotating, the cylinder end seals 161*a*, 161*b* are 'thrown' against the housing seals 181*a*, 181*b*. The maximum speed of rotation occurs at the midpoints between the direction reversals. Those midpoints occur when the piston rod 157 is at its maximum and minimum extents and is reversing direction. Those same points also occur when the cylinder end seals 161*a*, 161*b* are at a knife-edge point between the closing of one port in the housing seals 181*a*, 181*b* and the opening of the other. This extra sealing force might require use of better wearing materials in the seals 161*a*, 161*b*, 181*a*, 181*b* in high RPM applications.

In some applications, either the housing seals 181*a*, 181*b* or the cylinder end seals 161*a*, 161*b* can be dispensed with. For example, if the assembly 150 were used in a compressor or pump, the housing seals 181*a*, 181*b* can be eliminated. The cylinder end seals 161*a*, 161*b* can press with force against the inside of the housing 152 during the compression or pumping stroke while gas or liquid is forced through a fixed exit port in the housing 152. Once that stroke is completed, a check valve in the exit port could restrain leakage from that port while pressure within the cylinder drops during the intake stroke. In a steam or other external combustion engine, the cylinder end seals 161*a*, 161*b* might be dispensed with and a cylinder with solid ends, as shown in FIG. 7, might be used. When one of the seals is dispensed with, the space between the cylinder 151 and the housing 152 might not be as effectively sealed from intake or exhaust. That might prevent use of that space to cool the cylinder 151 as illustrated in FIG. 13.

The cylinder 151 of the assembly 150, shown in FIGS. 13-17, are relatively light. That helps to minimize the energy which is necessarily used in accelerating the cylinder 151 through its speed and direction changes. The energy used is not necessarily lost to the system, though. There are potential means to store that energy and reuse it. Perhaps simplest would be to use a spring similar to the balance springs of traditional mechanical watches to help maintain the rotational oscillations of the cylinder 151. If the assembly is used in a limited RPM range, the spring could be 'tuned' to provide the best storage and recovery of rotational momentum. More complicated variable rate springing might be used for assemblies with wider RPM ranges. Pneumatic or even electromagnetic means to store and recover such energy are also possible. By such means, the cylinder assemblies of this invention could be used to achieve significant energy savings when compared to assemblies with conventional valve trains.

Figure 19A:
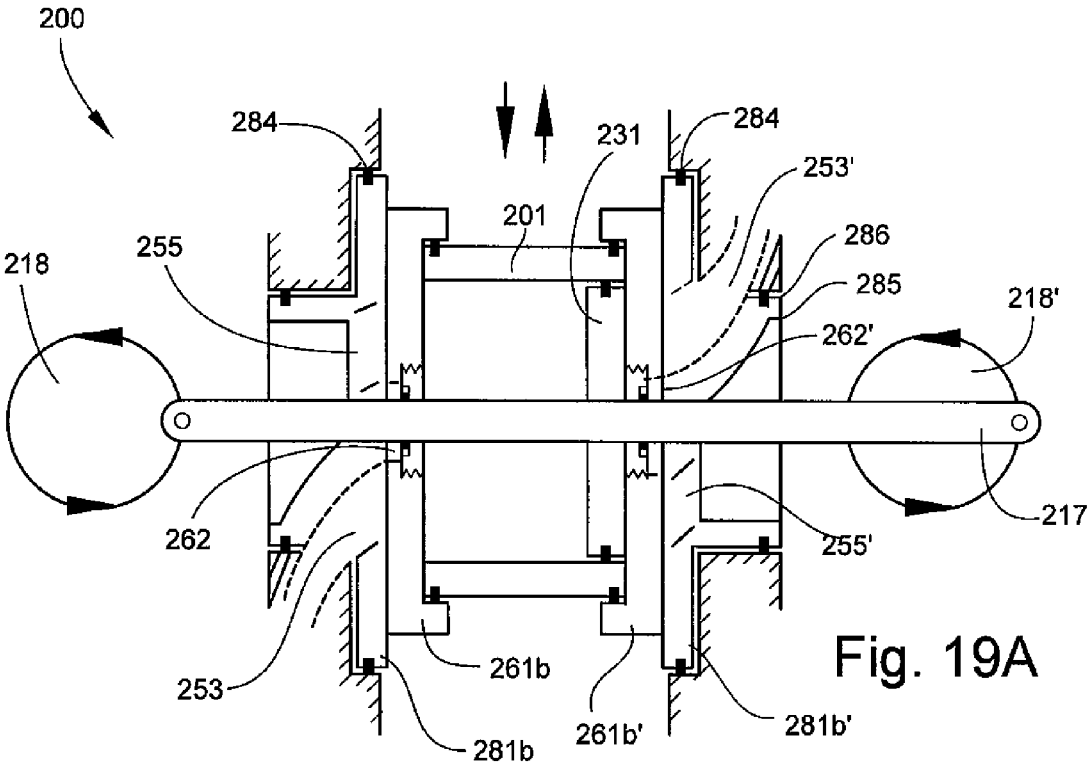
FIG. 19A is a cross sectional view of the mechanical seals of FIG. 13 adapted for use in a sliding cylinder assembly, with the cranks shown in the extreme right 'dead' position, according to another embodiment of the invention.

The seals 161*a*, 161*b*, 181*a*, 181*b* illustrated in FIGS. 13-18, could be adapted for use in a linearly sliding cylinder assembly 200, as shown in FIGS. 19A-D. The cylinder assembly 200 has a piston head 231 and rod 217 connected to two cranks 218, 218' rotating together. The cranks 218, 218' can be made to rotate together by means of a gear 207 engaging with two other gears 208, 209 shown in FIG. 20, that are attached to the two cranks 218, 218'. FIG. 19A, which is analogous to FIG. 13, shows seals 261*b*, 261*b*', 281*b*, 281*b*' for such a mechanism. The piston rod 217 extends from both ends of the cylinder 201 to connect to the two cranks 218, 218'. The housing seals 281*b*, 281*b*' for both cylinder ends have slots for the piston rod 217 to slide up and down in, such as illustrated in FIG. 16B. Other than that, the difference between the seals for this assembly 200 and those illustrated in FIGS. 13-18 is that the sealing faces are planar rather than spherical. The piston rod slot 230 is not shown in FIG. 19A so as not to obscure the ports.

Figure 19B:
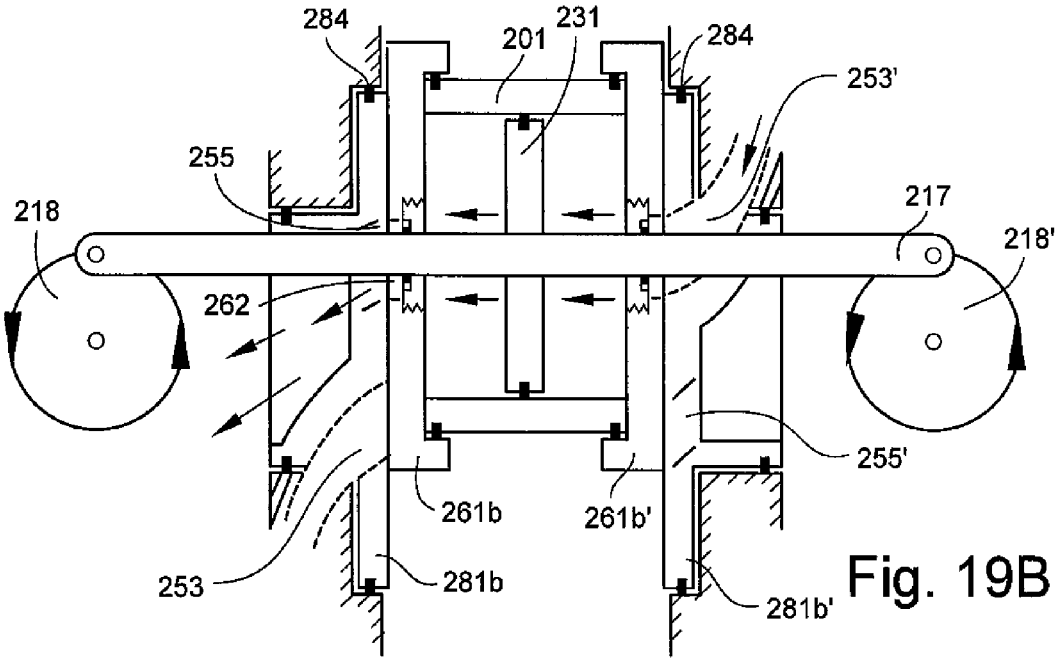
FIG. 19B is another cross sectional view of the cylinder assembly of FIG. 19A, showing the cranks in the top center active position.
Figure 19C:
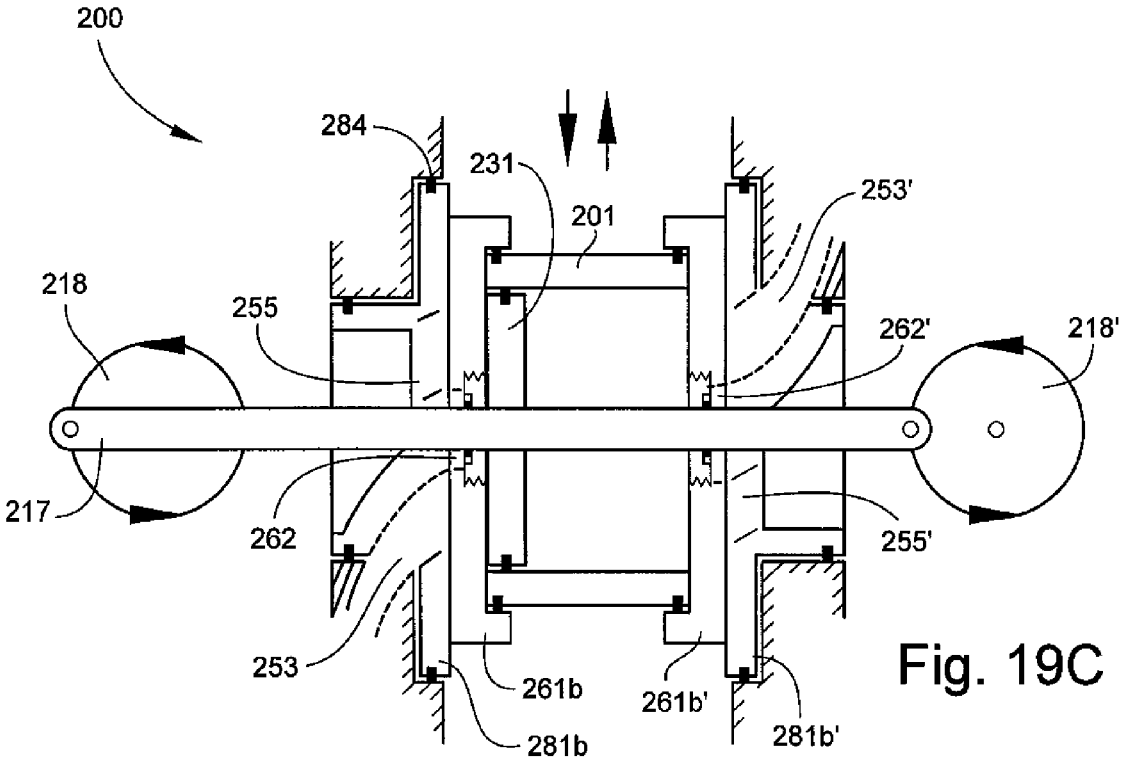
FIG. 19C is yet another cross sectional view of the cylinder assembly of FIG. 19A, showing the cranks in the extreme left 'dead' position.
Figure 19D:
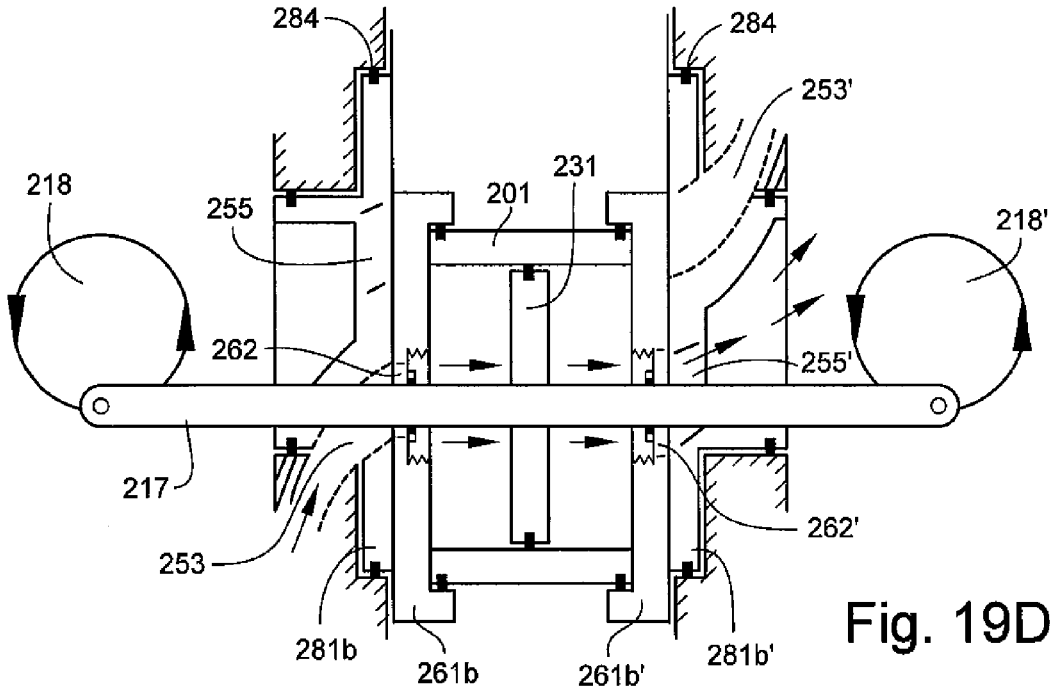
FIG. 19D is yet another cross sectional view of the cylinder assembly of FIG. 19A, showing the cranks in the bottom center active position.
Figure 20:
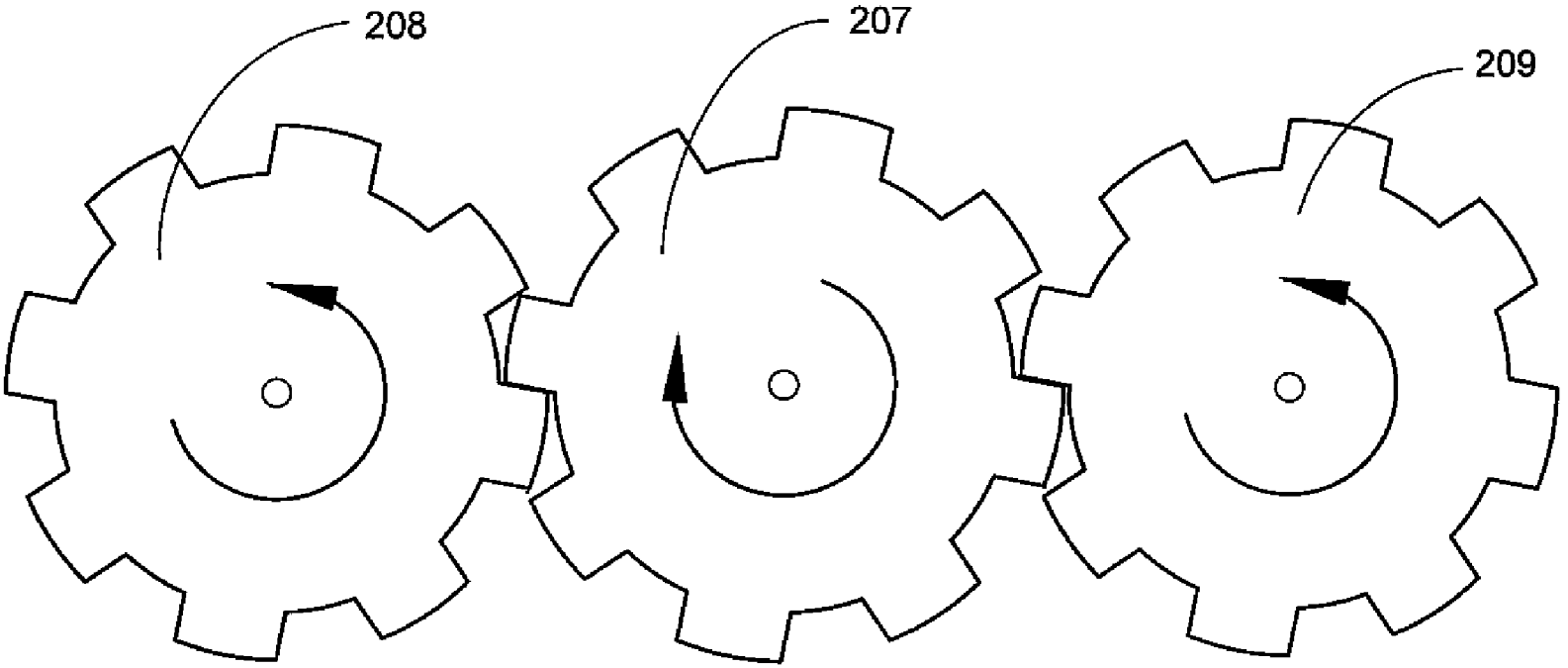
FIG. 20 is a schematic view of a means for coordinating the movements of the two cranks in the cylinder assembly of FIG. 19A.
Figure 21A:
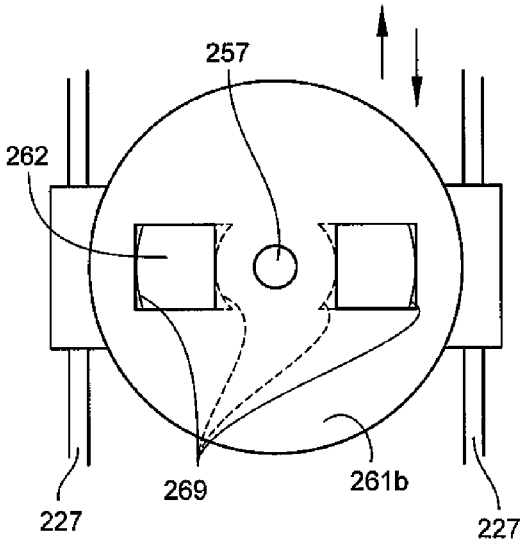
FIGS. 21A-B are face elevations of the cylinder end and housing seals for the cylinder assembly of FIG. 19A.
Figure 21B:
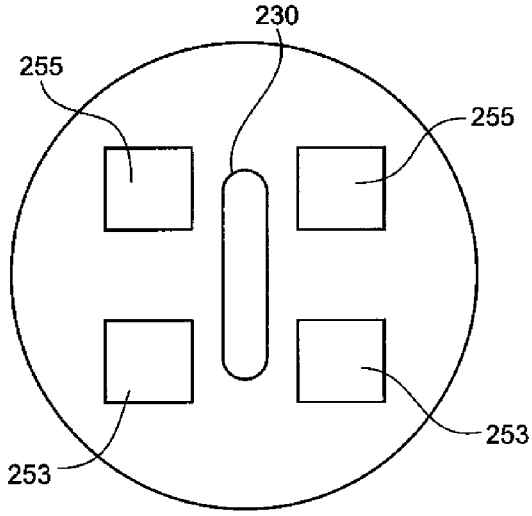

FIG. 20 shows how the two cranks 218, 218' can be connected to a single gear 207 rotating in the opposite direction. Such a gear 207 would be the natural power take-off point. FIG. 20 shows that power take-off gear 207 sharing the same rotational speed as the two cranks 218, 218'. Alternatively, it could be geared to have either a higher or lower speed. FIG. 19A shows the cylinder assembly 200 with the cranks 218, 218' in their extreme right 'dead' (or transitional) position. FIG. 19B shows the assembly 200 with the cranks 218, 218' in their top 'active' center position. FIG. 19C shows the assembly 200 with the cranks 218, 218' in their extreme left 'dead' position. FIG. 19D shows the assembly 200 with their cranks 218, 218' in their bottom 'active' center position. FIG. 21 A shows the face of one of the cylinder end seals 261*b*. The ports 262 on the face of the cylinder end seal 261*b* are preferably rectangular. As the cylinder 201 slides up and down, those ports 262 would align with the rectangular ports 255, 253 at the top and bottom of the face of the housing seal 281*b*, which is shown in FIG. 21B. The ports on the face of the other cylinder end seal 261*b*' are similar and function in conjunction with the ports 253', 255' of the other housing seal 281*b*' in the same way.

Figure 21C:
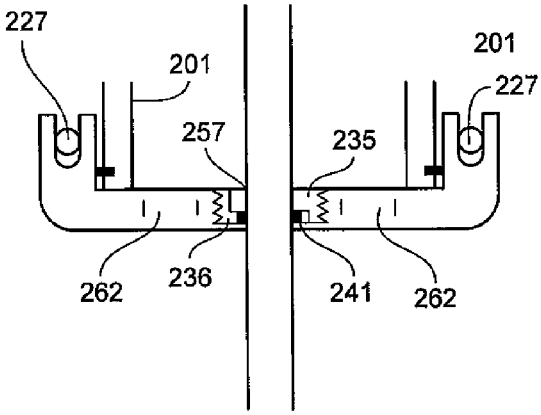
FIG. 21C is a top side plan view of the cylinder end seal of FIG. 21A.
Figure 21D:
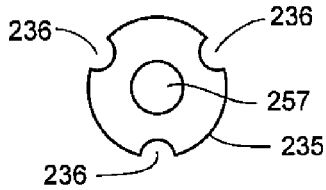
FIG. 21D is a top plan view of the plug used in the piston rod sealing assembly of FIG. 21C.
Figure 21E:
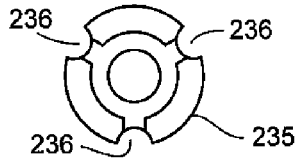
FIG. 21E is a bottom plan view of the plug used in the piston rod sealing assembly of FIG. 21C.
Figure 21F:
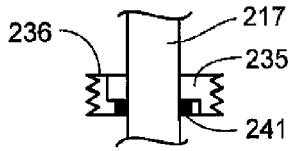
FIG. 21F is an enlarged cross sectional view of the plug of FIGS. 21C-E through one of the side channels, which allows high pressure to the back side of the sealing ring.

The back side of the housing seals 281*b*, 281*b*' would be like that shown in FIG. 16B, except that the back side of the seals 281*b*, 281*b*' around the pipe-like extension would be planar. FIG. 21 A shows the ports 262 in the cylinder end seal 261*b* having a contour 269 in the passage from the cylinder side to the side facing the housing seal 281*a*. The ports 262 on the cylinder side are curved next to the walls of the cylinder barrel 201, and around the rod sealing ring 241 and plug 235 so as to maximize the area of those ports 262. The curvature shown at 269 around the rod sealing assembly is shown in phantom. FIG. 21A also shows the cylinder seal 261*b* sliding up and down on rods 227 which serve to prevent the rotation of the cylinder end seal 261*b*. The housing seals 281*b*, 281*b*' would be prevented from rotating without any such means by the up and down movement of the piston rod 217 in the slot 230. FIG. 21C shows a top view of the cylinder end seal 261*b* of FIG. 21A. FIGS. 21D and 21E show top and bottom views, respectively, of the plug 235 surrounding the piston rod ring seal 241. The channels 236 shown in FIGS. 21C-F on the edge of the plug 235 and on the bottom to the cavity for the ring 241 would allow high pressure to the backside of the ring 241. FIG. 21F shows an enlarged cross sectional view of the plug 235 of FIGS. 21C-E through one of the side edge channels 236.

Figure 22:
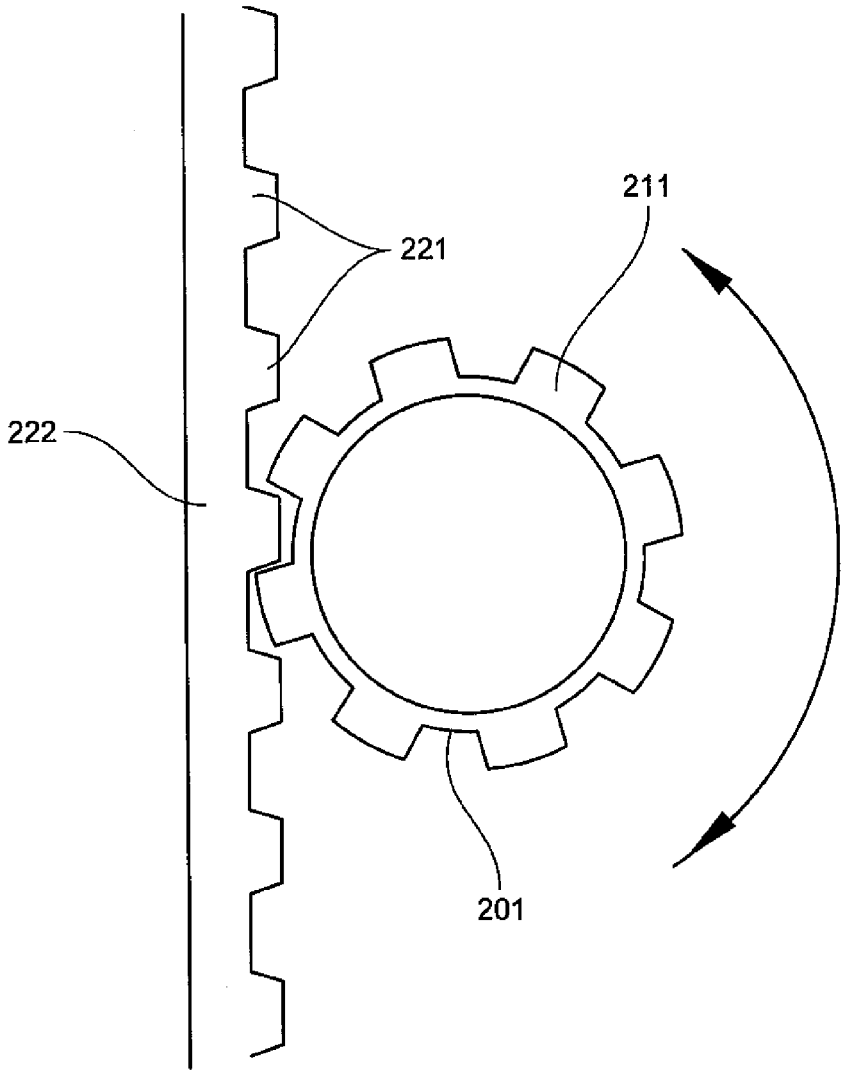
FIG. 22 is a cross sectional view of a means to rotate the cylinder of the sliding cylinder assembly of FIG. 19A.

The assembly 200 shown in FIGS. 19A-D particularly suited for an additional refinement. The linearly sliding cylinder 201 could be made to spin while it slides by having teeth 211 on the outside of the cylinder engage teeth 221 on a rack 222, as illustrated in FIG. 22. This prevents the loss of hydrodynamic lubrication, with resulting metal on metal contact, as the piston head 231 reaches the end of its throws and momentarily stops while it reverses direction. This feature would spin the cylinder 201 with maximum speed just as the piston head 231 is stopping and changing directions. The cylinder 201 would stop its spinning and change spin directions when the piston head 231 is moving with maximum speed through the cylinder 201. This provides a better wearing engine.

Figure 23:
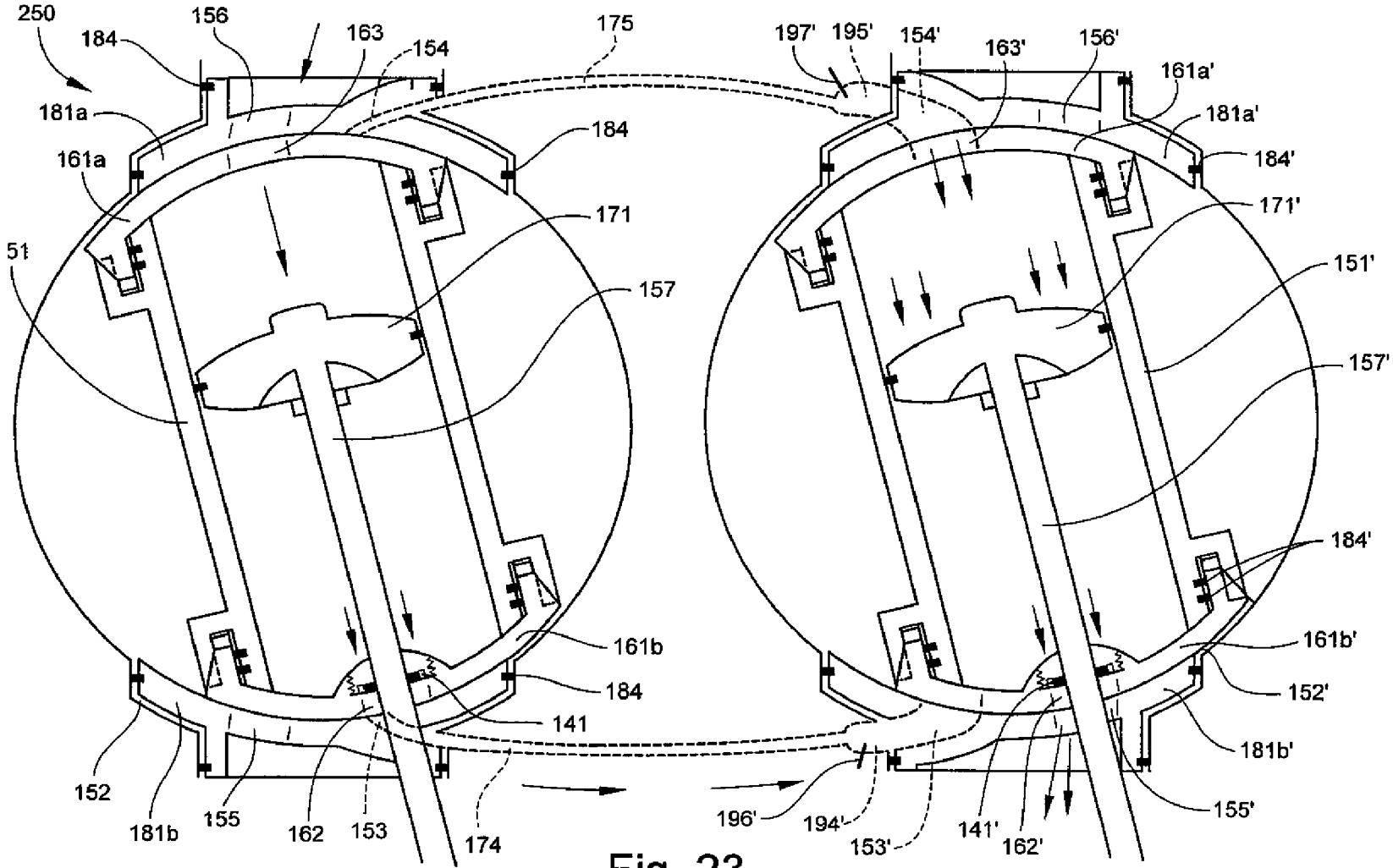
FIG. 23 is a schematic view of a pair of cylinder assemblies in operation together in an internal combustion engine, according to another embodiment of the invention.

An illustration of how the cylinder assembly of the present invention can be used in an internal combustion engine can be made with reference to FIG. 23. FIG. 23 shows an assembly 250 comprising a pair of cylinders 151, 151', in which one cylinder 151 is used to perform intake and compression and the other cylinder 151' is used to perform power and exhaust with a clockwise movement of the crankshaft. The first cylinder 151 is shown in the midst of a downward stroke which is performing intake on the top side of the piston head 171, and compression on the bottom side. The second cylinder 151' is shown in the midst of a power stroke on the top side and an exhaust stroke on the bottom side. All four strokes of a four stroke engine are occurring at the position represented. It is equivalent to a four cylinder engine where each of the four strokes is being accomplished in a different cylinder. This is possible in the two cylinders 151, 151', because the volumes on both sides of the piston heads 171, 171' are working volumes, as in old fashioned steam engines.

With continued rotation of the crankshaft, the pistons 157, 157' would reverse directions. With upward movement of the pistons 157, 157', the first cylinder 151 would then be performing compression on the top side of the piston head 171 and intake on the bottom side. The second cylinder 151' would have exhaust on the top side and power on the bottom side of the piston head 171'.

After the intake stroke is completed on each side of the piston head 171 in the first cylinder 151, rotation of the cylinder end seals 161*a*, 161*b* would close the intake ports 155, 156 in the appropriate housing seal 181*a*, 181*b*, and open that cylinder end port 162, 163 to the compression exit port 153, 154 in the appropriate housing seal 181*a*, 181*b*. For example, during the bottom side compression stroke, compressed gases are pushed into a passage 174 from the first cylinder 151 to an ignition chamber 194' which includes the high pressure port 153' of the appropriate housing seal 181*b*' of the second cylinder 151'. While that is happening, the high pressure port 153' is sealed from the second cylinder 151' as the relevant working volume is engaged in exhaust. When the bottom side compression stroke is completed in the first cylinder 151, the compression exit port 153 is closed by rotation of the cylinder end seal 161*b*. Just as that port 153 closes in the first cylinder 151, the second cylinder 151' end seal port 162' is revealed to the ignition chamber 194'. That revealing begins the bottom side power phase in the second cylinder 151'. At the end of the power stroke, the second cylinder's end seal port 162' closes to the ignition chamber 194', and then opens to the low pressure port 155' for the exhaust stroke. Combustion starts at a point 196' in the ignition chamber 194' either by spark or by injection of fuel into highly compressed air. A similar ignition is shown at reference numeral 197' for the top side ignition chamber 195'.

The intake and exhaust on the bottom sides of the cylinders 151, 151' could have separate porting and additional seals such as illustrated in FIG. 17. Alternatively, the intake and exhaust could be done through the crankcase. In that case, the crankcase would have to have two separate chambers sealed from each other.

FIG. 23 shows the cylinders 151, 151' being connected by passages 174, 175 leading to ignition chambers 194', 195', respectively, at the housing seals' high pressure ports 153', 154' for the second cylinder. An alternative arrangement would be to have the passage 174 and ignition chamber 194' be one, and the same for passage 175 and ignition chamber 195'. The passage 174 could grow in cross section as it traverses from the first cylinder 151 to the second cylinder 151' resulting in a horn shape. Here ignition could begin closer to the first cylinder 151 with the resulting flame front moving through the chamber towards and eventually into the second cylinder 151'. This arrangement may be preferred where sufficient scale, and perhaps also ceramic coatings or sleeves, effectively prevents flame quenching inside a horn shaped chamber.

Ceramic coatings may be preferred elsewhere in the assembly 250. A ceramic coating of both sides of the cylinder end seals 161*a*', 161*b*' in the second cylinder would help prevent deformation of those seals 161*a*', 161*b*' from exposure to the high temperatures of combustion. Deformation of those seals 161*a*', 161*b*' could compromise the effectiveness of the sealing interfaces of the second cylinder 151'. Any coatings of the end seals' faces pressing against the housing seals 181*a*', 181*b*' would also have to be essentially blemish free to maintain the same effectiveness. Use of ceramic coatings in the ignition chambers 194', 195', on the end seals 161*a*', 161*b*' of the second cylinder 151', and perhaps also on the piston head 171' and piston rod seal plug of the second cylinder 151', would serve to increase the thermal efficiency of the engine. Preferably, the temperature decreases in the second cylinder 151' after the power strokes are completed are due to the performance of work, not from cooling imposed simply to prevent overheating of the parts of the assembly 250. Larger expansion volumes in the second cylinder 151' than compression volumes in the first cylinder 151 would also serve the interest of a thermally efficient engine.

This engine layout, with the first cylinder 151 doing intake and compression on both sides of the piston head 171, and the second cylinder doing power and exhaust on both sides of that piston head 171', is quite flexible. The second cylinder 151' could be made larger than the first cylinder 151 to achieve a larger expansion volume than compression volume. Additionally, the first cylinder 151 could be brought to top dead center and bottom dead center somewhat before the second cylinder 151'. By doing so, additional time could be given to combustion without igniting combustion before the end of the compression stroke. The cylinders 151, 151' can also be arranged in a 'V' relation to the crankshaft, which would enable shorter passages 174, 175 between the two cylinders 151, 151' at both ends and allow the cylinders 151, 151' to be closer without interfering with each other.

Figure 24A:
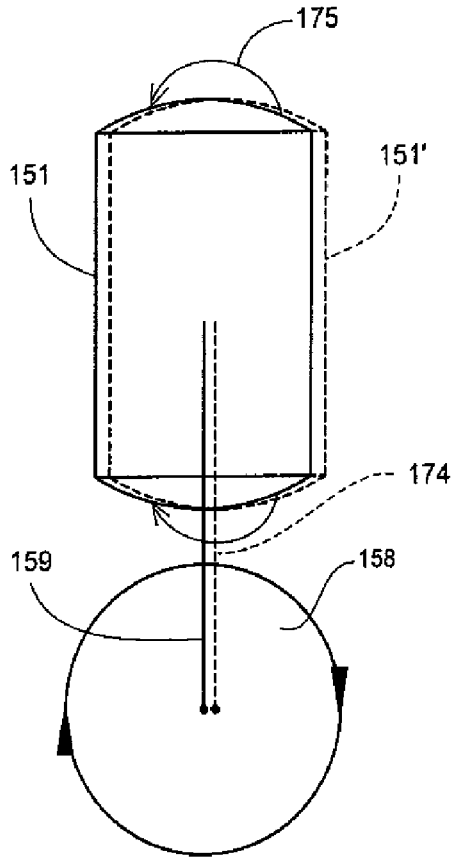
FIG. 24A is a schematic view of the internal combustion assembly of FIG. 23 in an in-line arrangement, according to another embodiment of the invention.
Figure 24B:
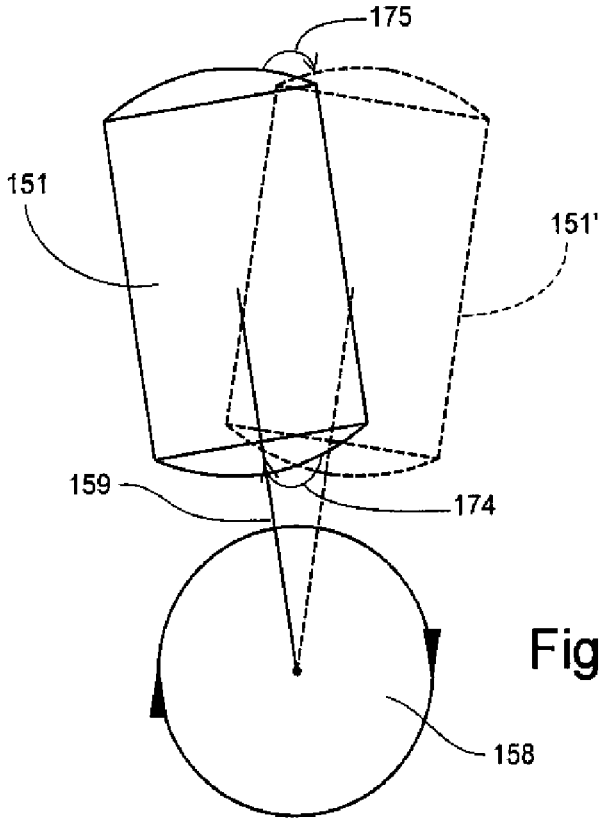
FIG. 24B is a schematic view of the internal combustion assembly of FIG. 23 in a "V" arrangement, according to another embodiment of the invention.

The latter possibility is illustrated in FIGS. 24A and 24B. FIG. 24A shows the inline cylinder assembly positions from the view of the centerline of the crankshaft 158, with one cylinder 151 in the foreground, and the other cylinder 151' behind. The assembly positions are only shown in outline and for where they are at top and bottom dead center. The first cylinder 151 is shown with solid lines and the second cylinder is shown in phantom. The crankshaft centerline is shown skewed very slightly to the right for the more distant cylinder 151', so as to allow easy visualization of the separate cylinders 151, 151'. As seen in FIG. 23, the passages 174, 175 from the first cylinder 151 to the second cylinder exit from the right side of the first cylinder and enter the left side of the second cylinder. The right to left traverse of the passages 174, 175 with respect to the centerline is shown by the arrow lines in FIG. 24A. FIG. 24B shows the cylinders 151, 151' in a 'V' relation to the crankshaft 158. The arrow lines again show the direction of passage flows from the first cylinder 151 to the second cylinder 151'. The passages 174, 175 are made more in line with the crankshaft 158 and are thereby shortened. The non-crank end passage 175 has a left to right flow with respect to the crankshaft 158.

FIG. 23 illustrates an embodiment in which intake and compression are performed in the first cylinder 151, and power and exhaust are performed in the second cylinder 151' on both sides of the pistons heads 171, 171'. An alternative arrangement would be to have the first cylinder 151 perform intake and compression on the top side and power and exhaust on the bottom side of the piston 171. The second cylinder 151' then would perform power and exhaust on the top side and intake and compression on the bottom side. Unfortunately, this arrangement does not have the flexibility of the assembly 250 represented in FIG. 23. Expansion volumes cannot be made larger than compression volumes on both sides of the piston heads 171, 171'. Also, more time cannot be provided for combustion on both sides by having one cylinder 151 reach top dead center and bottom dead center ahead of the other cylinder 151'. Additionally, passages 174, 175 between the two cylinders 151, 151' cannot be shortened on both top and bottom sides by having a 'V' relation to the crankshaft 158. Nevertheless, this arrangement might be preferred for smaller and simpler engines for use where 2-stroke engines are currently often used. Such small engines generally are lubricated by using fuel with oil mixed in. If one cylinder 151' performs power and exhaust on both sides, as shown in FIG. 23, the walls of that cylinder 151' might not receive adequate lubrication. Those walls would never have contact with an un-combusted air/fuel/lubricant mixture. An arrangement where each cylinder 151, 151' performs intake and compression on one side of the piston heads 171, 171' would insure adequate lubrication of the walls of both cylinders 151, 151'.

Figure 25A:
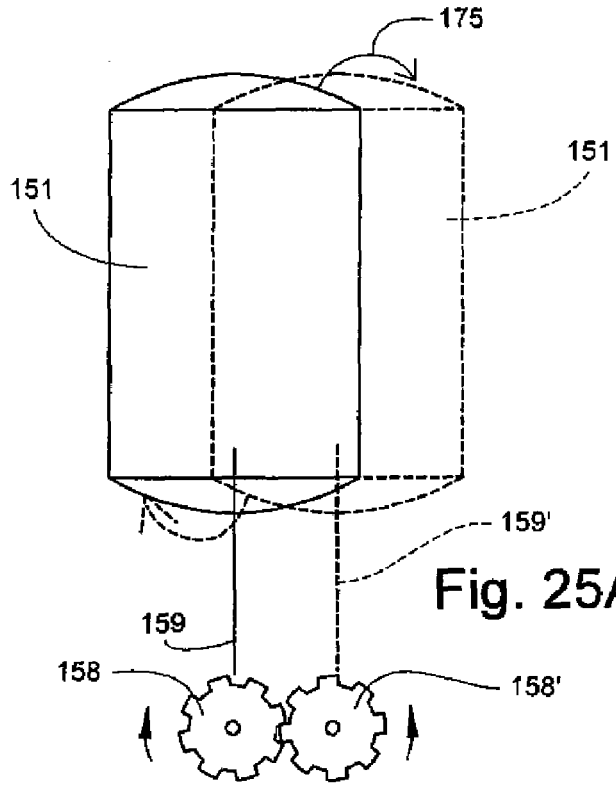
FIG. 25A is a schematic view of an internal combustion engine assembly according to another embodiment of the invention, with counter-rotating cranks in an offset in-line arrangement.

Although a 'V' relation would not work, there is a way to shorten the passages between the cylinders 151, 151'. FIG. 25A shows an arrangement where the two cylinders 151, 151' work with different cranks 158, 158' rotating in opposite directions. By having a different crank direction, the sides where the high pressure ports enter or exit are reversed. Except for the amount of offset of the two cranks 158, 158', the passages 174, 175 between the two cylinders 151, 151' are made in line. The passage 175 from the first cylinder 151 to the second cylinder 151' is shown with a solid arrow on the top. The passage 174 from the second cylinder 151' to the first cylinder 151 on the bottom is shown with an arrow in phantom. With one crank 158 and the cylinders 151, 151' necessarily in line, the passages 174, 175 would be longer as shown in FIG. 24A.

Figure 25B:
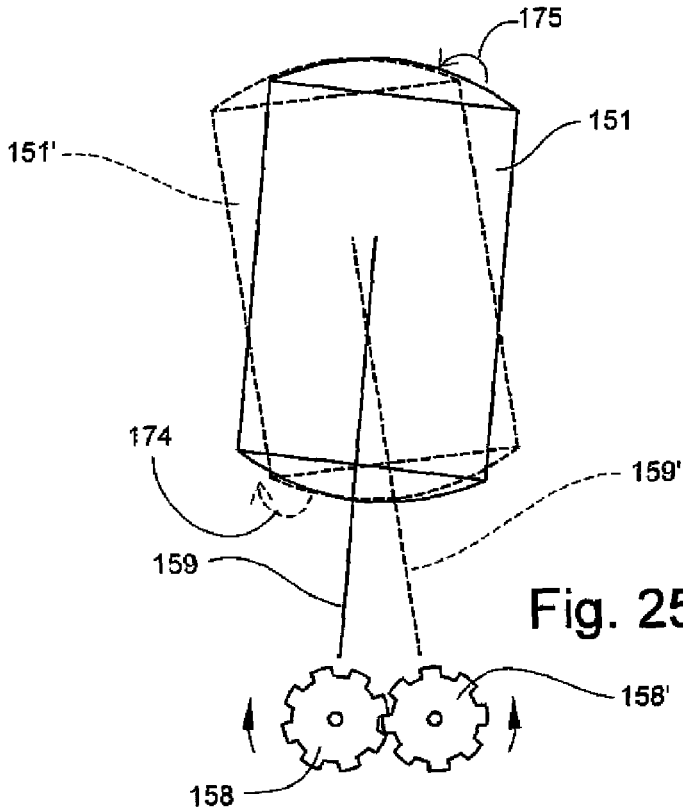
FIG. 25B is a schematic view of the assembly of FIG. 25A, with counter-rotating cranks in an offset "X" arrangement.

FIG. 25B shows that by having the two cylinders 151, 151' form an 'X' relation with respect to the two cranks 158, 158', the passages 174, 175 can be further shortened and the whole two cylinder engine assembly 250 made more compact. Again, the passage from the first cylinder 151 to the second cylinder 151' is shown solid on the top, and the passage from the second cylinder 151' to the first cylinder 151 is shown in phantom on the bottom. If as shown in FIG. 25B, the two cylinders 151, 151' share the same pivot point, the trunnions between the two cylinders 151, 151' could fit, with bearings, one inside the other. This would permit the cylinders 151, 151' to be thereby closer.

The figures of this application show no dead space when the pistons are at the end of their 'throws'. In general, some clearance would be desirable, especially in higher RPM applications.

Most of the cylinder assemblies presented here have sealing interfaces which are spherical, which is the preferred shape. An alternative embodiment of the invention comprises a cylinder assembly with planar sealing faces used in conjunction with a linearly sliding cylinder and two cranks. Although the latter embodiment may have some advantage with respect to longevity, it has a disadvantage of larger size and weight. With necessary changes, a cylindrical interface could be made to work. With a cylindrical interface, housing seals and cylinder end seals would have to be larger if round piston type rings are used in sealing the edges of those seals. Also, the piston heads would be larger and more massive if they are shaped to minimize dead space at the end of piston travel. As such, it would be less preferred.

An invention relating to a moving cylinder assembly having explicit seals, and methods for using the same are disclosed above. Various details of the invention may be changed without departing from its scope. Furthermore, the foregoing description of the preferred embodiments of the invention and the best mode for practicing the invention are provided for the purpose of illustration only and not for the purpose of limitation—the invention being defined by the claims.

I claim:

1. A moving cylinder assembly comprising:

(a) an end ported moveable cylinder defining a chamber for receiving and engaging a piston connected to at least one crank;

(b) a stationary housing embracing the cylinder and defining at least one port for intermittent communication with the cylinder chamber; and (c) a first seal having a port formed therethrough, the seal positioned within the housing and adjacent the cylinder for minimizing leakage, and wherein a face of the seal around the port extends beyond a marginal surrounding of the port.

2. A cylinder assembly according to claim 1, wherein the cylinder movement is rotational oscillation.

3. A cylinder assembly according to claim 1, wherein the cylinder movement is linear oscillation.

4. A cylinder assembly according to claim 1, wherein the seal comprises a resilient membrane or coating attached to the housing.

5. A cylinder assembly according to claim 1, wherein the seal comprises a resilient membrane or coating attached to the cylinder.

6. A cylinder assembly according to claim 1, wherein the seal comprises a mechanical seal.

7. A cylinder assembly according to claim 6, wherein the seal presses against the cylinder by high pressure entering a crevice space between the seal and the housing.

8. A cylinder assembly according to claim 7, further comprising means for keeping the crevice space between the seal and the housing open.

9. A cylinder assembly according to claim 8, wherein the means for keeping the crevice space open comprises one or more selected from the group consisting of a bump, pin, channel, grid, and spring.

10. A cylinder assembly according to claim 7, wherein the crevice space is sealed by a second seal attached to the housing and pressing against the first seal.

11. A cylinder assembly according to claim 7, wherein the crevice space is sealed by a second seal attached to the first seal and pressing against the housing.

12. A cylinder assembly according to claim 6, further comprising at least one spring for maintaining continuous pressure of the first seal against the cylinder.

13. A cylinder assembly according to claim 1, further comprising a mechanical second ported seal attached to the cylinder and pressing against the first seal for controlling leakage.

14. A cylinder assembly according to claim 13, further comprising a third seal attached to the second seal and pressing against the cylinder for controlling leakage between the second seal and the cylinder.

15. A cylinder assembly according to claim 13, further comprising a third seal attached to the cylinder and pressing against the second seal for controlling leakage between the second seal and the cylinder.

16. A cylinder assembly according to claim 13, further comprising at least one spring for maintaining continuous pressure of the second seal against the first seal.

17. A cylinder assembly according to claim 1, wherein the seal comprises a mechanical ported seal attached to the cylinder.

18. A cylinder assembly according to claim 17, further comprising at least one spring for maintaining continuous pressure of the seal against the housing.

19. A cylinder assembly according to claim 1, further comprising means for dissipating excess heat.

20. A cylinder assembly according to claim 19, wherein the means for dissipating excess heat comprises cooling fins attached to the cylinder.

21. A cylinder assembly according to claim 1, wherein energy required for momentum reversals of the moving cylinder is at least partially stored and released by at least one spring.

22. A cylinder assembly according to claim 1, wherein energy required for momentum reversals of the moving cylinder is at least partially stored and released by one or more of the group consisting of magnetic, electric, or electromagnetic means.

23. A cylinder assembly according to claim 3, further comprising:

(a) a first set of teeth attached to the cylinder; and (b) a second set of complimentary teeth positioned on a fixed rack, whereby the cylinder spins by engagement of the first and second sets of teeth.

24. An internal combustion engine comprising:

(a) a pair of cylinder assemblies, each cylinder assembly comprising:

(i) a moving cylinder defining a chamber for receiving and engaging a piston connected to at least one crank, (ii) a stationary housing embracing the cylinder and defining at least one port for intermittent communication with the cylinder chamber, and (iii) a first mechanical seal having a port formed therethrough, the seal positioned within the housing and adjacent the cylinder for minimizing leakage, and wherein a face of the seal around the port extends beyond a marginal surrounding of the port; and (b) wherein at least one port of the first seal of at least one of the assemblies forms part of a passage from a working volume used for intake and compression to a corresponding working volume used for power and exhaust.

25. An internal combustion engine according to claim 24, wherein at least one port of the first seal for a working volume used for power and exhaust forms part of a combustion chamber associated with that working volume.

26. An internal combustion engine according to claim 24, wherein the piston of each of the cylinder assemblies is attached to counter-rotating cranks.

27. An internal combustion engine according to claim 24, wherein the cylinder assemblies are arranged in an 'X' pattern.

28. A cylinder according to claim 1, wherein the face of the first seal is substantially greater in area than the port.

* * * * *